US005819212A

United States Patent [19]

Matsumoto et al.

[11] Patent Number: 5,819,212

[45] Date of Patent: Oct. 6, 1998

[54] VOICE ENCODING METHOD AND APPARATUS USING MODIFIED DISCRETE COSINE TRANSFORM

[75] Inventors: Jun Matsumoto; Shiro Omori; Masayuki Nishiguchi; Kazuyuki Iijima, all of Tokyo, Japan

[73] Assignee: Sony Corporation, Tokyo, Japan

[21] Appl. No.: 736,507

[22] Filed: Oct. 24, 1996

[30] Foreign Application Priority Data

Oct. 26, 1995 [JP] Japan ..... 7-302130
Oct. 26, 1995 [JP] Japan ..... 7-302199

[51] Int. Cl.[6] ..... G10L 9/00

[52] U.S. Cl. ..... 704/219; 704/220; 704/221; 704/222; 704/229; 704/230

[58] Field of Search ..... 704/219, 220, 704/221, 222, 229, 230

[56] References Cited

U.S. PATENT DOCUMENTS

| | | | |
|---|---|---|---|
| 3,750,024 | 7/1973 | Dunn et al. | 704/219 |
| 4,959,863 | 9/1990 | Azuma et al. | 380/38 |
| 5,138,662 | 8/1992 | Amano et al. | 381/36 |
| 5,151,941 | 9/1992 | Nishiguchi et al. | 381/46 |
| 5,251,261 | 10/1993 | Meyer et al. | 381/36 |
| 5,371,853 | 12/1994 | Kao et al. | 395/2.32 |
| 5,444,816 | 8/1995 | Adoul et al. | 395/2.28 |
| 5,473,727 | 12/1995 | Nishiguchi et al. | 395/2.31 |
| 5,600,374 | 2/1997 | Shikakura | 348/398 |
| 5,621,856 | 4/1997 | Akagiri | 395/2.38 |

*Primary Examiner*—David R. Hudspeth
*Assistant Examiner*—Vijay B. Chawan
*Attorney, Agent, or Firm*—Jay H. Maioli

[57] ABSTRACT

A method and apparatus for encoding an input signal, such as a broad-range speech signal, in which a number of decoding operations with different bit rates are enabled for assuring a high encoding bit rate and for minimizing deterioration of the reproduced sound even with a low bit rate. The signal encoding method includes a band-splitting step for splitting an input signal into a number of bands and a step of encoding signals of the bands in a different manner depending on signal characteristics of the bands. Specifically, a low-range side signal is taken out by a low-pass filter from an input signal entering a terminal, and analyzed for Linear Predictive coding by an Linear Predictive coding analysis quantization unit. After finding the Linear Predictive coding residuals, as short-term prediction residuals by an Linear Predictive coding inverted filter, the pitch is found by a pitch analysis circuit. Then, pitch residuals are found by long-term prediction by a pitch inverted filter. The pitch residuals are processed with modified discrete cosine transform by a modified discrete cosine transform (MDCT) circuit and vector-quantized by a vector-quantization circuit. The resulting quantization indices are transmitted along with the pitch lag and the pitch gain. The linear spectral pairs linear spectral pairs are also sent as parameter representing LPC coefficients.

10 Claims, 18 Drawing Sheets

VOICE ENCODING METHOD AND APPARATUS USING MODIFIED DISCRETE COSINE TRANSFORM

BACKGROUND OF THE INVENTION

1. Field of the Invention

This invention relates to a method and apparatus for encoding an input signal, such as a broad-range speech signal. More particularly, the invention relates to a signal encoding method and apparatus in which the frequency spectrum of the input signal is split into a telephone band for which sufficient clarity as speech can be obtained and a remaining band in which signal encoding can be realized by an independent codec and in which the telephone band is substantially unaffected.

2. Description of the Related Art

There are a variety of methods known for compressing audio signals, inclusive of speech and acoustic signals, by exploiting statistic properties of the audio signals and psychoacoustic characteristics of the human being. The encoding methods may be roughly classified into encoding on the time axis, encoding on the frequency axis, and analysis synthesis encoding.

Among the known techniques for high efficiency encoding for speech signals or the like, there exist harmonic encoding, sinusoidal analytic encoding, such as multi-band excitation (MBE) encoding, sub-band encoding (SBC), linear predictive coding (LPC), discrete cosine transform (DCT), modified DCT (MDCT) and fast Fourier transform (FFT).

There have also been known a variety of encoding techniques for dividing an input signal into plural bands prior to encoding. However, the encoding for the lower frequency range has been performed by the same method as that for the higher frequency range. Thus, there are occasions when an encoding method appropriate for the high frequency range signals has been used, resulting in poor encoding efficiency for the encoding of the low frequency range signals. Of course, the same problem occurs when an encoding method appropriate for low frequency range signals is also used to encode high frequency range signals. In particular, optimum encoding occasionally cannot be performed when the signal is transmitted with a low bit rate.

Although some signal decoding devices now in use are designed to operate with various different bit rates, it is inconvenient to use different devices for the different bit rates. That is, it is desirable that a single device can encode or decode signals of plural different bit rates.

Meanwhile, it has recently been recognized that it would be desirable for a bitstream to have scalability such that a bitstream having a high bit rate is received and, if the bitstream is decoded directly, high-quality signals are produced, whereas, if a specified portion of the bitstream is decoded, signals of low sound quality are produced.

Heretofore, a signal to be processed is roughly quantized on the encoding side to produce a bitstream with a low bit rate. For this bitstream, the quantization error produced on quantization is further quantized and added to the bitstream of the low bit rate to produce a high bit rate bitstream. In this case, if the encoding method remains essentially the same, the bitstream can have scalability as described above, that is, a high-quality signal can be obtained by directly decoding the high bit rate bitstream, while a low bit rate signal can be reproduced by taking out and decoding a portion of the bitstream.

However, the above-mentioned complete inclusive relation cannot be constituted with ease if it is desired to encode the speech at, for example, three bit rates of 2 kbps, 6 kbps and 16 kbps, while maintaining scalability.

That is, for encoding with as high signal quality as possible, waveform encoding is preferably performed with a high bit rate. If waveform encoding cannot be achieved smoothly, encoding has to be performed using a model for a low bit rate. The above inclusive relation in which the high bit rate includes the low bit rate cannot be achieved because of the difference in the information for encoding.

SUMMARY OF THE INVENTION

It is therefore an object of the present invention to provide a speech encoding method and apparatus in which band splitting for encoding the playback speech with a high quality may be produced with a smaller number of bits, and signal encoding for a pre-set band, such as a telephone band, can be realized by independent codec.

It is another object of the present invention to provide a method for multiplexing encoded signals in which plural signals which cannot be encoded by the same method because of a significant difference in the bit rates are adapted to have as much common information as possible and encoded by essentially different methods for assuring scalability.

It is yet another object of the present invention to provide a signal encoding apparatus employing the multiplexing method for multiplexing the encoded signal.

In one aspect, there is provided a signal encoding method including a band-splitting step for splitting an input signal into plurality of bands and encoding signals of the bands in a different manner depending on signal characteristics of the bands.

In another aspect, the present invention provides a method and apparatus for multiplexing an encoded signal having speech encoding means in turn having means for multiplexing a first encoded signal obtained on first encoding of an input signal employing a first bit rate and a second encoded signal obtained on second encoding of the input signal and means for multiplexing the first encoded signal and a portion of the second encoded signal excluding the portion thereof in common with the first encoded signal. The second encoded signal has a portion in common with only a portion of the first encoded signal and a portion not in common with the first encoded signal. The second encoding employs a second bit rate different from the bit rate for the first encoding.

According to the present invention, the input signal is split into plural bands and signals of the bands thus split are encoded in a different manner depending on signal characteristics of the split bands. Thus a decoder operation with different rates is enabled and encoding may be performed with an optimum efficiency for each band thus improving the encoding efficiency.

By performing short-term prediction on the signals of a lower side one of the bands for finding short-term prediction residuals, performing long-term prediction on the short-term prediction residuals thus found and by orthogonal transforming the long-term prediction residuals thus found, a higher encoding efficiency may be achieved along with a reproduced speech of superior quality.

Also, according to the present invention, at least a band of the input signal is taken out, and the signal of the band thus taken out is orthogonal-transformed into a frequency-domain signal. The orthogonal-transformed signal is shifted on the frequency axis to another position or band and subsequently inverse orthogonal-transformed to time-domain signals, which are encoded. Thus the signal of an arbitrary frequency band is taken out and converted into a low-range side for encoding with a low sampling frequency.

In addition, a sub-band of an arbitrary frequency width may be produced from an arbitrary frequency range so as to be processed with a sampling frequency twice the frequency width thus enabling an application to be dealt with flexibly.

DESCRIPTION OF THE PREFERRED EMBODIMENTS

Preferred embodiments of the present invention will now be explained in detail.

Figure 1:
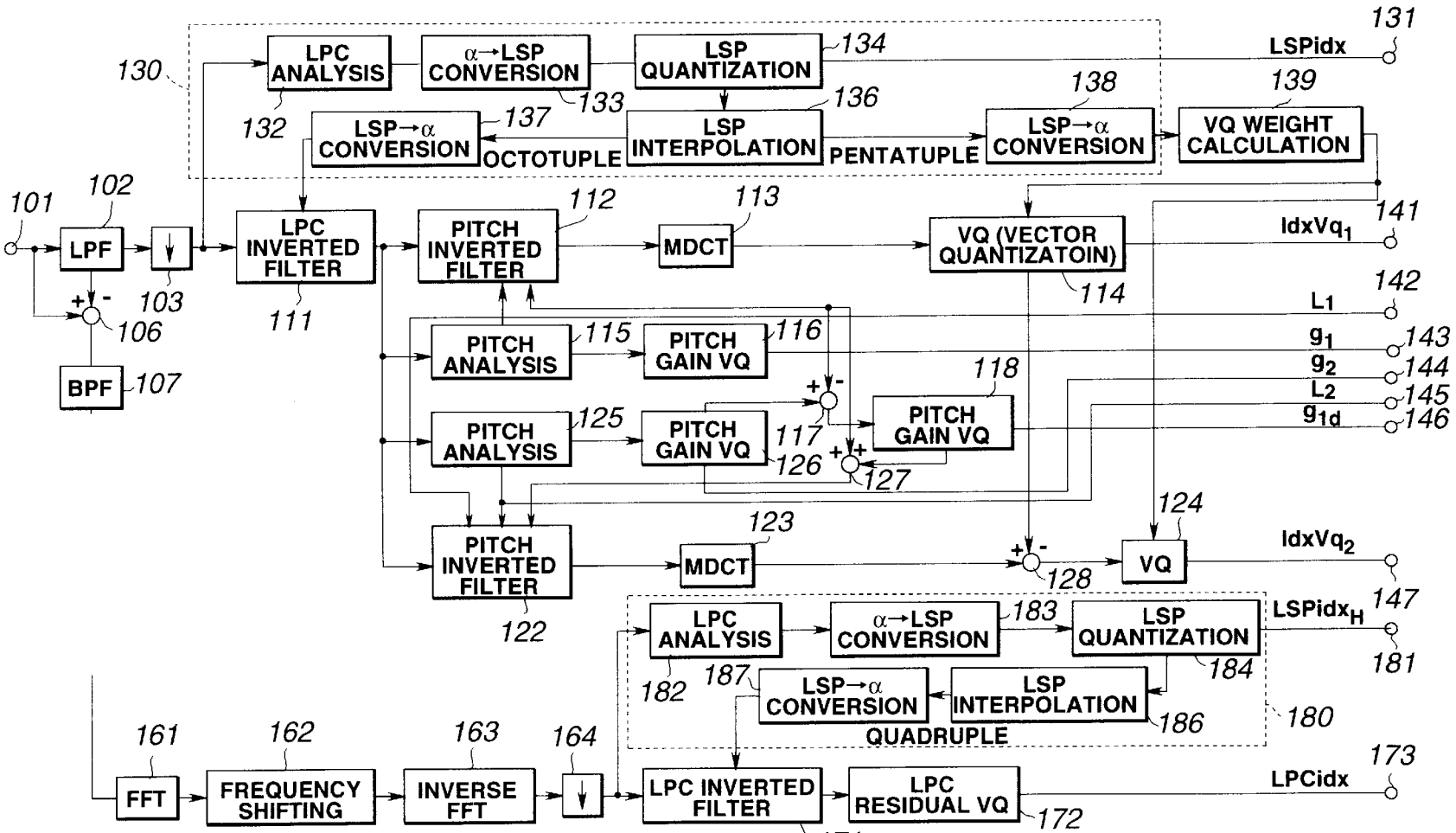
FIG. 1 is a block diagram showing a basic structure of a speech signal encoding apparatus for carrying out the encoding method embodying the present invention.

FIG. 1 shows an encoding apparatus (encoder) for broad-range speech signals for carrying out the speech encoding method according to the present invention.

The basic concept of the encoder shown in FIG. 1 is that the input signal is split into plural bands and the signals of the split bands are encoded in a different manner depending on signal characteristics of the respective bands. Specifically, the frequency spectrum of the broad-range input speech signals is split into plural bands, namely the telephone band for which sufficient clarity as speech can be achieved, and a band on the higher side relative to the telephone band. The signals of the lower band, that is, the telephone band, are orthogonal-transformed after short-term prediction such as linear predictive coding (LPC) followed by long-term prediction, such as pitch prediction, and the coefficient obtained on orthogonal transform is processed with perceptually weighted vector quantization. The information concerning long-term prediction, such as pitch or pitch gain, or parameters representing the short-term prediction coefficients, such as LPC coefficients, are also quantized. The signals of the band higher than the telephone band are processed with short-term prediction and then vector-quantized directly on the time axis.

The modified DCT (MDCT) is used as the orthogonal transform. The conversion length is shortened for facilitating weighting for vector quantization. In addition, the conversion length is set to $2^N$, that is, to a value equal to powers of 2, for enabling high processing speed by employing fast Fourier transform (FFT). The LPC coefficients for calculating the weighting for vector quantization of the orthogonal transform coefficients and for calculating the residuals for short-term prediction (similarly for a post-filter) are the LPC coefficients smoothly interpolated from the LPC coefficients found in the current frame and those found in the past frame, so that the LPC coefficients used will be optimum for each sub-frame being analyzed. In performing the long-term prediction, prediction or interpolation is carried out a number of times for each frame and the resulting pitch lag or pitch gain is quantized directly or after finding the difference. Alternatively, a flag specifying the method for interpolation is transmitted. For prediction residuals the variance of which becomes smaller with an increased number of times (frequency) of prediction, multi-stage vector quantization is carried out for quantizing the difference of the orthogonal transform coefficients. Alternatively, only the parameters for a given band among the split bands are used for enabling plural decoding operations with different bit rates by all or part of a given encoded bitstream.

Referring now to FIG. 1, to an input terminal 101 are supplied broad-band speech signals in a range of, for example, from 0 to 8 kHz with a sampling frequency Fs of, for example, 16 kHz. The broad-band speech signals from the input terminal 101 are split by a low-pass filter 102 and a subtractor 106 into low-range telephone band signals of, for example, 0 to 3.8 kHz, and high-range signals, such as signals in a range of, for example, from 3.8 kHz to 8 kHz. The low-range signals are decimated by a sampling frequency converter 103 in a range satisfying the well-known conventional sampling theorem to provide e.g., 8 kHz-sampling signals.

The low-range signals are multiplied by an LPC analysis quantization unit 130 by a Hamming window with an analysis length on the order of, for example, 256 samples per block. The LPC coefficients of, for example, 10 order, that is, $\alpha$-parameters, are found, and LPC residuals are found by an LPC inverted filter 111. During this LPC analysis, 96 of 256 samples of each block, functioning as a unit for analysis, are overlapped with the next block, so that the frame interval becomes equal to 160 samples. This frame interval is 20 msec for 8 kHz sampling. An LPC analysis quantization unit 130 converts the α-parameters as LPC coefficients into linear spectral pair (LSP) parameters which are then quantized and transmitted.

Specifically, an LPC analysis circuit 132 in the LPC analysis quantization unit 130, fed with the low-range signals from the sampling frequency converter 103, applies a Hamming window to the input signal waveform, with the length of the order of 256 samples of the input signal waveform as one block, in order to find linear prediction coefficients, that is, so-called α-parameters, by an autocorrelation method. The framing interval, as a data outputting unit, is e.g., 20 msec or 160 samples.

The α-parameters from the LPC analysis circuit 132 are sent to an α-LSP conversion circuit 133 for conversion into linear spectra pair (LSP) parameters. That is, the α-parameters, found as direct type filter coefficients, are converted into, for example, ten LSP parameters, or five pairs of LSP parameters. This conversion is performed using, for example, the Newton-Rhapson method. The reason for conversion to the LSP parameters is that the LSP parameters are superior to the α-parameters in interpolation characteristics.

The LSP parameters from the α-LSP conversion circuit 133 are vector- or matrix-quantized by an LSP quantizer 134. The vector quantization may be executed after finding the inter-frame difference, while matrix quantization may be executed on plural frames grouped together. In the present embodiment, 20 msec is one frame and two frames of the LSP parameters, each calculated every 20 msec, are grouped together and quantized by matrix quantization.

A quantization output of the LSP quantizer 134, that is the indices of the LSP vector quantization, is taken out via a terminal 131, while the quantized LSP parameters, or dequantized outputs, are sent to an LSP interpolation circuit 136.

The function of the LSP interpolation circuit 136 is to interpolate a set of the current frame and a previous frame of the LSP vectors vector-quantized every 20 msec by the LSP quantizer 134 in order to provide a rate required for subsequent processing. In the present embodiment, an octotuple rate and a quintuple rate are used. With the octotuple rate, the LSP parameters are updated every 2.5 msec. The reason is that, since analysis synthesis processing of the residual waveform leads to an extremely smooth waveform of the envelope of the synthesized waveform, extraneous sounds may be produced if the LPC coefficients are changed rapidly every 20 msec. That is, if the LPC coefficients are changed gradually every 2.5 msec, such extraneous sound may be prevented from being produced.

For inverted filtering of the input speech using the interpolated LSP vectors, occurring every 2.5 msecs, the LSP parameters are converted by an LSP to α conversion circuit 137 into α-parameters which are the coefficients of the direct type filter of, for example, approximately 10 orders. An output of the LSP to α conversion circuit 137 is sent to an LPC inverted filter circuit 111 for finding the LPC residuals. The LPC inverted filter circuit 111 executes inverted filtering on the α-parameters updated every 2.5 msec for producing a smooth output.

The LSP coefficients, at an interval of 4 msec, interpolated at a quintuple rate by the LSP interpolation circuit 136, are sent to a LSP-to α converting circuit 138 where they are converted into α-parameters. These α-parameters are sent to a vector quantization (VQ) weighting calculating circuit 139 for calculating the weighting used for quantization of MDCT coefficients.

An output of the LPC inverted filter 111 is sent to pitch inverted filters 112, 122 for pitch prediction for long-term prediction.

The long-term prediction is now explained. The long-term prediction is executed by finding the pitch prediction residuals by subtracting from the original waveform the waveform shifted on the time axis in an amount corresponding to the pitch lag or pitch period as found by pitch analysis. In the present embodiment, the long-term prediction is executed by three-point pitch prediction. Meanwhile, the pitch lag means the number of samples corresponding to the pitch period of sampled time-domain data.

That is, the pitch analysis circuit 115 executes pitch analysis once for each frame, that is, with the analysis length of one frame. Of the results of pitch analysis, a pitch lag $L_1$ is sent to the pitch inverted filter 112 and to an output terminal 142, while a pitch gain is sent to a pitch gain vector quantization (VQ) circuit 116. In the pitch gain VQ circuit 116, the pitch gain values at three points of the three-point prediction are vector-quantized and a codebook index $g_1$ is taken out at an output terminal 143, while a representative value vector or a dequantization output is sent to each of the inverted pitch filter 115, a subtractor 117 and an adder 127. The inverted pitch filter 112 outputs a pitch prediction residual of the three-point prediction based upon the results of pitch analysis. The prediction residual is sent to, for example, an MDCT circuit 113, as orthogonal transform means. The resulting MDCTed output is quantized with perceptually weighted vector quantization by a vector quantization (VQ) circuit 114. The MDCTed output is quantized with perceptually weighted vector quantization by the vector quantization (VQ) circuit 114 by an output of the VQ weighting calculation circuit 139. An output of the VQ circuit 114, that is an index $IdxVq_1$, is outputted at an output terminal 141.

In the present embodiment, a pitch inverted filter 122, a pitch analysis circuit 124 and a pitch gain VQ circuit 126 are provided as a separate pitch prediction channel. That is, a center of analysis is provided at an intermediate position of each pitch analysis center so that pitch analysis will be executed by a pitch analysis circuit 125 at a one-half frame period. The pitch analysis circuit 125 routes a pitch lag $L_2$ to the inverted pitch filter 122 and to an output terminal 145, while routing the pitch gain to a pitch gain VQ circuit 126. The pitch gain VQ circuit 126 vector-quantizes the three-point pitch gain vector and sends an index $g_2$ of the pitch gain as a quantization output to an output terminal 144, while routing its representative vector or a dequantization output to a subtractor 117. Since the pitch gain at the center of analysis of the original frame period is thought to be close to the pitch gain from the pitch gain VQ circuit 116, a difference between dequantization outputs of the pitch gain VQ circuits 116, 126 is taken by a subtractor 117, as a pitch gain at the above-mentioned center of analysis position. This difference is vector-quantized by a pitch gain VQ circuit 118 to produce an index $g_{1d}$ of the pitch gain difference which is sent to an output terminal 146. The representative vector or the dequantized output of the pitch gain difference is sent to an adder 127 and summed to the representative vector or the dequantized output from the pitch gain VQ circuit 126. The resulting sum is sent as a pitch gain to the inverted pitch filter 122. Meanwhile, the index $g_2$ of the pitch gain obtained at the output terminal 143 is an index of the pitch gain at the above-mentioned mid, or center, position. The pitch prediction residuals from the inverted pitch filter 122 are MDCTed by a MDCT circuit 123 and sent to a subtractor 128 where the representative vector or the dequantized output from the vector quantization (VQ) circuit 114 is subtracted from the MDCTed output. The resulting difference is sent to the VQ circuit 124 for vector quantization to produce an index IdxVq2 which is sent to an output terminal 147. The VQ circuit quantizes the difference signal by perceptually weighted vector quantization with an output of a VQ weighting calculation circuit 139.

The high-range signal processing is now explained.

The signal processing for the high range signals basically consists in splitting the frequency spectrum of the input signals into plural bands, frequency-converting the signal of at least one high-range band to the low-range side, lowering the sampling rate of the signals converted to the low frequency side and encoding the signals lowered in sampling rate by predictive coding.

The broad-range signal supplied to the input terminal 101 of FIG. 1 is supplied to the subtractor 106. The low-range side signal, taken out by the low-pass filter (LPF) 102, such as the telephone band signal in a range of, for example, from 0 to 3.8 kHz, is subtracted from the broad-band signal. Thus the subtractor 106 outputs a high-range side signal, such as a signal in a range of, for example, from 3.8 to 8 kHz. However, due to characteristics of the actual LPF 102, the components lower than 3.8 kHz are left in a minor amount in the output of the subtractor 106. Thus the high-range side signal processing is performed on the components not lower than 3.5 kHz, or components not lower than 3.4 kHz.

This high-range signal has a frequency width of from 3.5 kHz to 8 kHz from the subtractor 106, that is a width of 4.5 kHz. However, since the frequency is shifted or converted by, for example, down-sampling, to a low range side, it is necessary to narrow the frequency range to, for example, 4 kHz. In consideration that the high range signal is combined with the low-range signal later on, the range of 3.5 kHz to 4 kHz, which is perceptually sensitive, is not cut, and the 0.5 kHz range from 7.5 kHz to 8 kHz, which is lower in power and psychoacoustically less critical as speech signals, is cut by the LPF or the band-pass filter 107.

The frequency conversion to the low-range side, which is then performed, is realized by converting the data into frequency domain data, using orthogonal transform means, such as a fast Fourier transform (FFT) circuit 161, shifting the frequency-domain data by a frequency shifting circuit 1 62, and by inverse FFTing the resulting frequency-shifted data by an inverse FFT circuit 164 as inverse orthogonal transform means.

From the inverse FFT circuit 163, the high-range side of the input signal, for example, the signal ranging from 3.5 kHz to 7.5 kHz, converted to a low range side of from 0 to 4 kHz, is taken out. Since the sampling frequency of this signal can be represented by 8 kHz, it is down-sampled by a down-sampling circuit 164 to form a signal of a range from 0 kHz to 4 kHz with the sampling frequency of 8 kHz. An output of the down-sampling circuit 164 is sent to each of the LPC inverted filter 171 and to an LPC analysis circuit 182 of an LPC analysis quantization unit 180.

The LPC analysis quantization unit 180, configured similarly to the LPC analysis quantization unit 130 of the low-range side, is now explained only briefly.

In the LPC analysis quantization unit 180, the LPC analysis circuit 182, to which is supplied a signal from the down-sampling circuit 164, converted to the low range, applies a Hamming window, with a length of the order of 256 samples of the input signal waveform, as one block, and finds linear prediction coefficients, that is, α-parameters, by, for example, an auto-correlation method. The α-parameters from the LPC analysis circuit 182 is sent to an α to LSP conversion circuit 183 for conversion into linear spectral pair (LSP) parameters. The LSP parameters from the α to LSP conversion circuit 183 are vector- or matrix-quantized by an LSP quantizer 184. At this time, an inter-frame difference may be found prior to vector quantization. Alternatively, plural frames may be grouped together and quantized by matrix quantization. In the present embodiment, the LSP parameters, calculated every 20 msec, are vector-quantized, with 20 msec as one frame.

A quantization output of the LSP quantizer 184, that is an index $LSPidx_H$, is taken out at a terminal 181, while a quantized LSP vector or the dequantized output, is sent to an LSP interpolation circuit 186.

The function of the LSP interpolation circuit 186 is to interpolate a set of the previous frame and the current frame of the LSP, vectors vector-quantized by the LSP quantizer 184 every 20 msec, to provide a rate necessary for subsequent processing. In the present embodiment, the quadruple rate is used.

For inverted filtering the input speech signal using the interpolated LSP vectors, occurring at the interval of 5 msec, the LSP parameters are converted by an LSP-to-α conversion circuit 187 into α-parameters as LPC synthesis filter coefficients. An output of the LSP-to-α conversion circuit 187 is sent to an LPC inverted filter circuit 171 for finding the LPC residuals. This LPC inverted filter 171 performs inverted filtering by the α-parameters updated every 5 msec for producing a smooth output.

The LPC prediction residual output from the LPC inverted filter 171 is sent to an LPC residual VQ (vector quantization) circuit 172 for vector quantization. The LPC inverted filter 171 outputs an index LPCidx of the LPC residuals, which is outputted at an output terminal 173.

In the above-described signal encoder, part of the low-range side configuration is designed as an independent codec encoder, or the entire outputted bitstream is changed over to a portion thereof or vice versa for enabling signal transmission or decoding with different bit rates.

That is, when transmitting all data from the respective output terminals of the configuration of FIG. 1, the transmission bit rate becomes equal to 16 kbps (k bits/sec). If data is transmitted from part of the terminals, the transmission bit rate becomes equal to 6 kbps.

Alternatively, if all data from all of the terminals of FIG. 1 are transmitted, that is, sent or recorded, and all data of 16 kbps are decoded on the receiving or reproducing side, high-quality speech signals of 16 kbps may be produced. On the other hand, if data of 6 kbps is decoded, speech signals having the sound quality corresponding to 6 kbps may be produced.

In the configuration of FIG. 1, output data at the output terminals 131 and 141 to 143 correspond to 6 kbps data, If output data at the output terminals 144 to 147, 173 and 181 are added thereto, all data of 16 kbps may be obtained.

Figure 2:
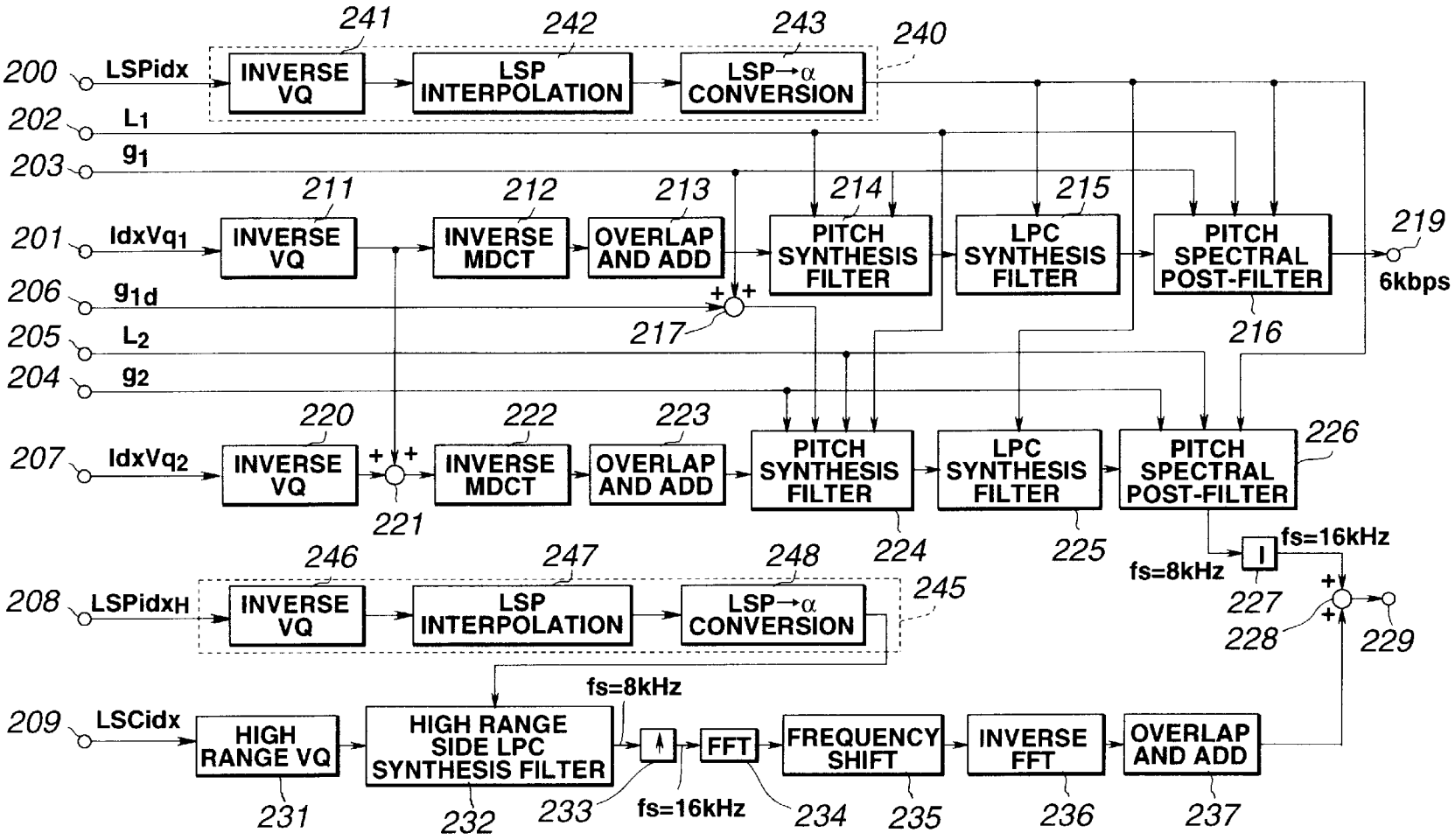
FIG. 2 is a block diagram for illustrating the basic structure of a speech signal decoding apparatus.

Referring to FIG. 2, a signal decoding apparatus (decoder), as a counterpart of the encoder shown in FIG. 1, is explained.

Referring to FIG. 2, a vector quantization output of the LSP, equivalent to an output of the output terminal 131 of FIG. 1, that is an index of a codebook LSPidx, is supplied to an input terminal 200.

The LSP index LSPidx is sent to an inverse vector quantization (inverse VQ) circuit 241 for LSPs of an LSP parameter reproducing unit 240 for inverse vector quantization or inverse matrix quantization into linear spectral pair (LSP) data. The LSP index, thus quantized, is sent to an LSP interpolation circuit 242 for LSP interpolation. The interpolated data is converted in an LSP-to-α conversion circuit 243 into α-parameters, as LPC coefficients, which are then sent to LPC synthesis filters 215, 225 and to pitch spectral post-filters 216, 226.

Figure 4:
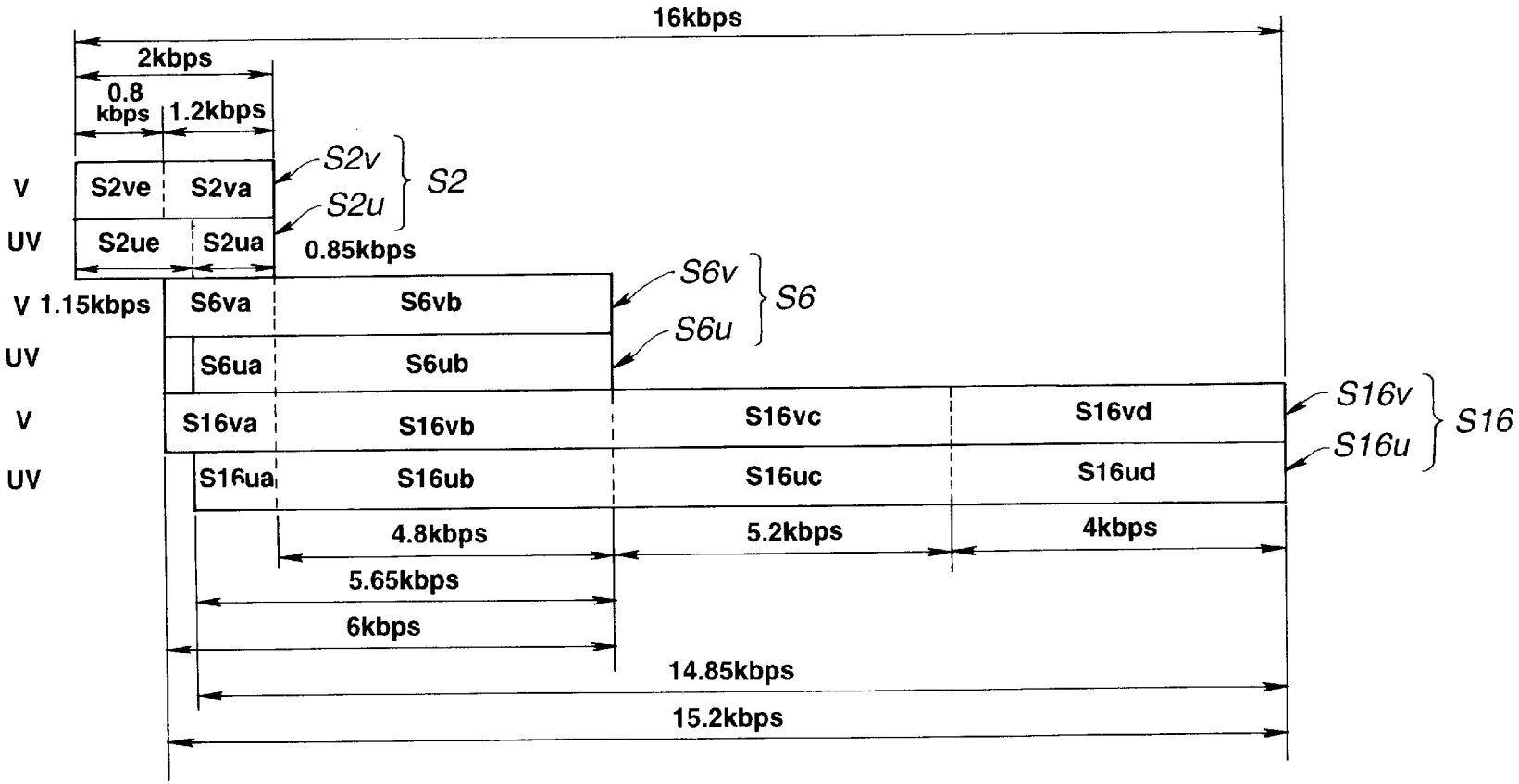
FIG. 4 illustrates scalability of a bitstream of transmitted encoded data.

To input terminals 201, 202 and 203 of FIG. 4, there are supplied the index $IsxVq_1$ for vector quantization of the MDCT coefficients, a pitch lag $L_1$ and a pitch gain g from the output terminals 141, 142, 143 of FIG. 1, respectively.

The index for vector quantization for MDCT coefficients $IsxVq_1$ from the input terminal 201 is supplied to an inverse VQ circuit 211 for inverse VQ and hence supplied to an inverse MDCT circuit 212 for inverse MDCT so as to be then overlap-added by an overlap-and-add circuit 213 and sent to a pitch synthesis filter 214. The pitch synthesis circuit 214 is supplied with the pitch lag $L_1$ and the pitch gain $g_1$ from the input terminals 202, 203, respectively. The pitch synthesis circuit 214 performs an inverse operation of pitch prediction encoding performed by the pitch inverted filter 215 of FIG. 1. The resulting signal is sent to an LPC synthesis filter 215 and processed with LPC synthesis. The LPC synthesis output is sent to a pitch spectral post-filter 216 for post-filtering so as to be then taken out at an output terminal 219 as speech signal corresponding to a bit rate of 6 kbps.

To input terminals 204, 205, 206 and 207 of FIG. 4 are respectively supplied a pitch gain $g_2$, a pitch $lag_2L$, an index $IsqVq_2$ and a pitch gain $g_1$ for vector quantization of the MDCT coefficients from output terminals 144, 145, 146 and 147, respectively.

The index $lsxVq_2$ for vector quantization of the MDCT coefficients from the input terminal 207 is sent to an inverse VQ circuit 220 for vector quantization and hence supplied to an adder 221 so as to be summed to the inverse VQed MDCT coefficients from the inverse VQ circuit 211. The resulting signal is inverse MDCTed by an inverse MDCT circuit 222 and overlap-added in an overlap-and-add circuit 223 so as to be hence supplied to a pitch synthesis filter 214. To this pitch synthesis filter 224 are supplied the pitch lag $L_1$, pitch gain $g_2$ and the pitch lag $L_2$ from the input terminals 202, 204 and 205, respectively, and a sum signal of the pitch gain $g_1$ from the input terminal 203 summed to the pitch gain $g_{1d}$ from the input terminal 206 at an adder 217. The pitch synthesis filter 224 synthesizes pitch residuals. An output of the pitch synthesis filter is sent to an LPC synthesis filter 225 for LPC synthesis. The LPC synthesized output is sent to a pitch spectral post-filter 226 for post-filtering. The resulting post-filtered signal is sent to an up-sampling circuit 227 for up-sampling the sampling frequency from e.g., 8 kHz to 16 kHz, and hence supplied to an adder 228.

To the input terminal 207 is also supplied an LSP index $LSPidX_H$ of the high range side from the output terminal 181 of FIG. 1. This LSP index $LSPidx_H$ is sent to an inverse VQ circuit 246 for the LSP of an LSP parameter reproducing unit 245 so as to be inverse vector-quantized to LSP data. These LSP data are sent to an LSP interpolation circuit 247 for LSP interpolation. These interpolated data are converted by an LSP-to-α converting circuit 248 to an α parameter of the LPC coefficients. The α-parameter is sent to a high-range side LPC synthesis filter 232.

To an input terminal 209 is also supplied an index LPCidx, that is, a vector quantized output of the high-range side LPC residuals from the output terminal 173 of FIG. 1. This index is inverse VQed by a high-range side inverse VQ circuit 231 and hence supplied to a high-range side LPC synthesis filter 232. The LPC synthesized output of the high-range side LPC synthesis filter 232 has its sampling frequency up-sampled by an up-sampling circuit 233 from e.g., 8 kHz to 16 kHz and is converted into frequency-domain data by fast FFT by an FFT circuit 234 as orthogonal transform means. The resulting frequency-domain signal is then frequency-shifted to a high range side by a frequency shift circuit 235 and inverse FFTed by an inverse FFT circuit 236 into high-range side time-domain signals which then are supplied via an overlap-and-add circuit 237 to the adder 28.

The time-domain signals from the overlap-and-add circuit are summed by the adder 228 to the signal from the up-sampling circuit 227. Thus, an output is taken out at output terminal 229 as speech signals corresponding to a portion of the bit rate of 16 kbps. The entire 16 kbps bit rate signal is taken out after summing to the signal from the output terminal 219.

Now, scalability is explained.

In the configuration shown in FIGS. 1 and 2, two transmission bit rates of 6 kbps and 16 kbps are realized with encoding/decoding systems substantially similar to each other for realizing scalability in which a 6 kbps bitstream is completely included in the 16 kbps bitstream. If encoding/decoding with a drastically different bit rate of 2 kbps is desired, this complete inclusive relation is difficult to achieve.

If the same encoding/decoding system cannot be applied, it is desirable to maintain utmost commonality between systems in realizing scalability.

Figure 3:
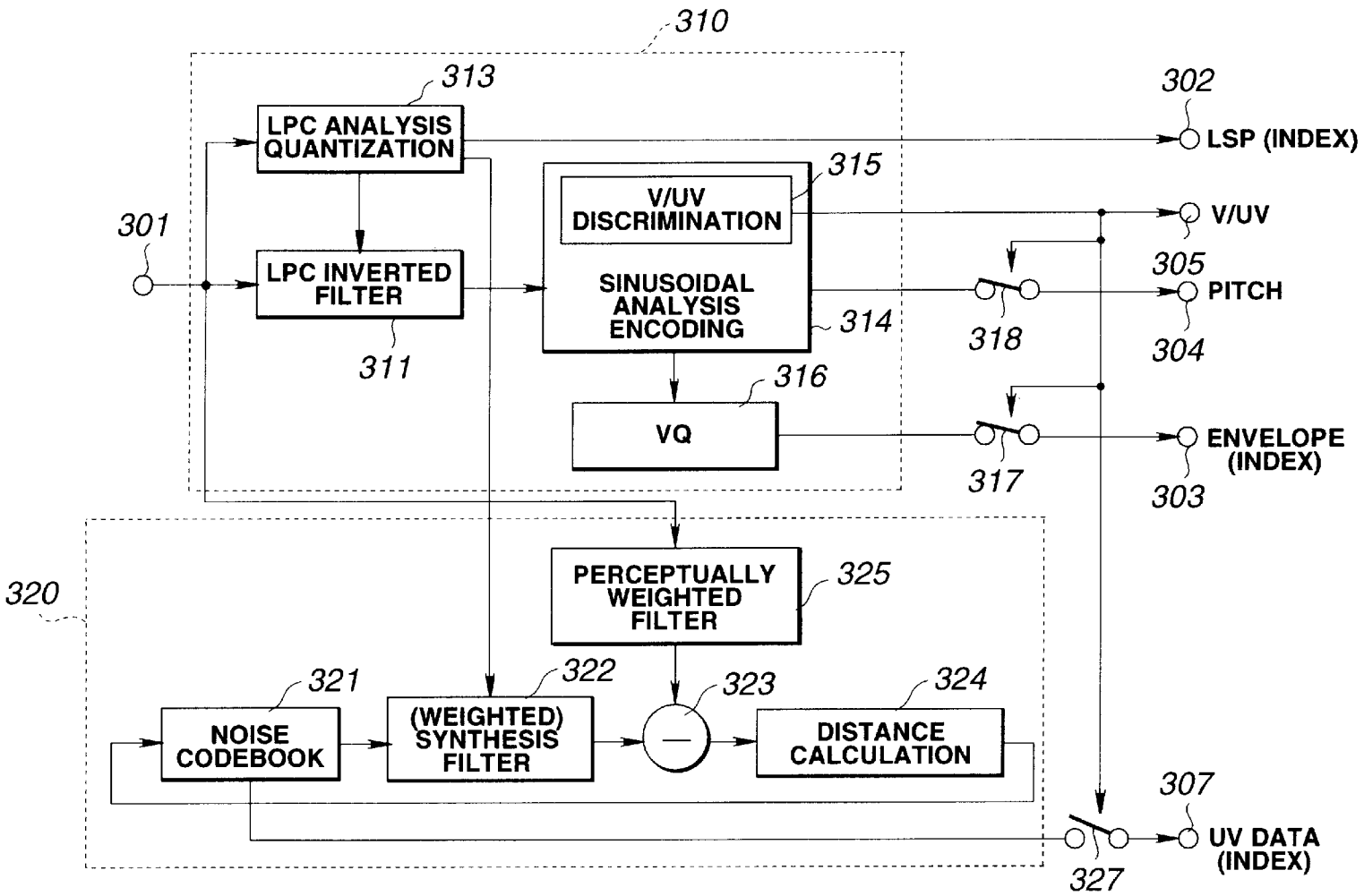
FIG. 3 is a block diagram for illustrating the structure of another speech signal encoding apparatus.

To this end, the encoder configured as shown in FIG. 3 is used for 2 kbps encoding and a maximum commonality in structure and data is shared with the configuration of FIG. 1. The 16 kbps bitstream on the whole is flexibly used so that the totality of 16 kbps, 6 kbps or 2 kbps will be used depending on usage.

Specifically, the totality of the information of 2 kbps is used for 2 kbps encoding, whereas, in the 6 kbps mode, the information of 6 kbps and the information of 5.65 kbps are used if the frame as an encoding unit is voiced (V) and unvoiced (UV), respectively. In the 16 kbps mode, the information of 15.2 kbps and the information of 14.85 kbps are used if the frame as an encoding unit is voiced (V) and unvoiced (UV), respectively.

The structure and the operation of the encoding configuration for 2 kbps shown in FIG. 3 is explained.

The basic concept of the encoder shown in FIG. 3 resides in that the encoder includes a first encoding unit 310 for finding short-term prediction residuals of the input speech signal, for example, LPC residuals, for performing sinusoidal analysis encoding, such as harmonic coding, and a second encoding unit 320 for encoding by waveform encoding by phase transmission of the input speech signal. The first encoding unit 310 and the second encoding unit 320 are used for encoding the voiced portion of the input signal and for encoding the unvoiced portion of the input signal, respectively.

The first encoding unit 310 uses the configuration of encoding the LPC residuals by sinusoidal analysis encoding, such as harmonic encoding or multi-band encoding (MBE). The second encoding unit 320 uses the configuration of code excitation linear prediction (CELP) employing vector quantization by closed loop search of the optimum vector with the aid of the analysis-by-synthesis method.

In the embodiment of FIG. 3, the speech signal supplied to an input terminal 301 is sent to an LPC inverted filter 311 and to an LPC analysis quantization unit 313 of the first encoding unit 310. The LPC coefficients or the so-called α-parameters obtained by the LPC analysis quantization unit 313 are sent to the LPC inverted filter 311 for taking out linear prediction residuals (LPC residuals) of the input speech signal. The LPC analysis quantization unit 3 13 takes out a quantized output of the linear spectral pairs (LSPs) as later explained. The quantized output is sent to an output terminal 302. The LPC residuals from the LPC inverted filter 311 are sent to a sinusoidal analysis encoding unit 314 where the pitch is detected and the spectral envelope amplitudes are calculated. In addition, V/UV discrimination is performed by a V/UV discrimination unit 315. The spectra envelope amplitude data from the sinusoidal analysis encoding unit 314 is sent to a vector quantizer 316. The codebook index from the vector quantizer 316, as a vector quantization output of the spectral envelope, is sent via a switch 317 to an output terminal 303. An output of the sinusoidal analysis encoding unit 314 is sent via a switch 318 to an output terminal 304. The V/UV discrimination output of the V/UV discrimination unit 315 is sent to an output terminal 305, while being sent as a control signal to switches 317, 318. If the input signal is the voiced signal (V), the index and the pitch are selected and taken out at the output terminals 303, 304, respectively.

The second encoding unit 320 of FIG. 3 has, in the present embodiment, the CELP encoding configuration and executes vector quantization of the time-domain waveform using a closed loop search by an analysis by synthesis method in which an output of a noise codebook 321 is synthesized by a weighted synthesis filter 322, the resulting weighted speech is sent to a subtractor 323 where an error is found from the speech obtained on passing the speech signal supplied to the input terminal 301 through a perceptually weighting filter 325, the resulting error is sent to a distance calculation circuit 324 for distance calculation and a vector which minimizes the error is searched by the nose codebook 321. This CELP encoding is used for encoding the unvoiced portion as described above, such that the codebook index as the UV data from the noise codebook 321 is taken out at an output terminal 307 via a switch 327 which is turned on when the result of V/UV discrimination from the V/UV discrimination unit 315 indicated UV.

The above-described LPC analysis quantization unit 313 of the encoder may be used as part of the LPC analysis quantization unit 130 of FIG. 1, such that an output at the terminal 302 may be used as an output of the pitch analysis circuit 115 of FIG. 1. This pitch analysis circuit 115 may be used in common with a pitch outputting portion within the sinusoidal analysis encoding unit 314.

Although the encoding unit of FIG. 3 thus differs from the encoding system of FIG. 1, both systems have the common information and scalability as shown in FIG. 4.

Referring to FIG. 4, the bitstream S2 of 2 kbps has an inner structure for the unvoiced analysis synthesis frame different from one for the voiced analysis synthesis frame. Thus a bitstream S2v of 2 kbps for V is made up of two portions $\mathbf{S2}_{ve}$ and $\mathbf{S2}_{va}$, while a bitstream S2u of 2 kbps for UV is made up of two portions $\mathbf{S2}_{ue}$ and $\mathbf{S2}_{ua}$. The portion $\mathbf{S2}_{ve}$ has a pitch lag equal to 1 bit per 160 samples per frame (1 bit/160 samples) and an amplitude Am of 15 bits/160 samples, totalling at 16 bits/160 samples. This corresponds to data of 0.8 kbps bit rate for the sampling frequency of 8 kHz. The portion $\mathbf{S2}_{ue}$ is composed of LPC residuals of 11 bits/80 samples and a spare 1 bit/160 samples, totalling at 23 bits/160 samples. This corresponds to data having a bit rate of 1.15 kbps bit rate. The remaining portions $\mathbf{S2}_{va}$ and $\mathbf{S2}_{ua}$ represent portions in common with the portions of 6 kbps and 16 kbps. The portion $\mathbf{S2}_{va}$ is made up of the LSP data of 32 bits/320 samples, V/UV discrimination data of 1 bit/160 samples and a pitch lag of 7 bits/160 samples, totalling at 24 bits/160 samples. This corresponds to data having a bit rate of 1.2 kbps bit rate. The portions $\mathbf{S2}_{ua}$ is made up of the LSP data of 32 bits/320 samples and V/UV discrimination data of 1 bit/160 samples, totalling at 17 bits/160 samples. This corresponds to data having a bit rate of 0.85 kbps bit rate.

Similarly, the bitstream S6v of 6 kbps for V is made up of two portions $\mathbf{S6}_{va}$ and $\mathbf{S6}_{vb}$, while the bitstream S6u of 6 kbps for UV is made up of two portions $\mathbf{S6}_{ua}$ and $\mathbf{S6}_{ub}$. The portion $\mathbf{S6}_{va}$ has data contents in common with the portion $\mathbf{S2}_{va}$, as explained previously. The portion $\mathbf{S6}_{vb}$ is made up of a pitch gain of 6 bits/160 samples and pitch residuals of 18 bits/32 samples, totalling at 96 bits/160 samples. This corresponds to data of 4.8 kbps bit rate. The portion $\mathbf{S6}_{ua}$ has data contents in common with the portion $\mathbf{S2}_{ua}$, while the portion $\mathbf{S6}_{ub}$ has data contents in common with the portion $\mathbf{S6}_{vb}$.

Similarly to the bitstreams S2 and S6, the bitstream S16 of 16 kbps has an inner structure for the unvoiced analysis frame different in part from one for the voiced analysis frame. A bitstream S16v of 16 kbps for V is made up of four portions $\mathbf{S16}_{va}$, $\mathbf{S16}_{vb}$, $\mathbf{S16}_{vc}$ and $\mathbf{S16}_{vd}$, while a bitstream S16u of 16 kbps for UV is made up of four portions $\mathbf{S16}_{ua}$, $\mathbf{S16}_{ub}$, $\mathbf{S16}_{uc}$ and $\mathbf{S6}_{ud}$. The portion $\mathbf{S16}_{va}$ has data contents in common with the portions $\mathbf{S2}_{va}$ $\mathbf{S6}_{va}$, while the portion $\mathbf{S16}_{vb}$ has data contents in common with the portions $\mathbf{S6}_{vb}$, $\mathbf{S6}_{ub}$. The portion $\mathbf{S16}_{vc}$ is made up of a pitch lag of 2 bits/160 samples, a pitch gain of 11 bits/160 samples, pitch residuals of 18 bits/32 samples and S/M mode data of 1 bit/160 samples, totaling 104 bits/160 samples. This corresponds to a 5.2 kbps bit rate. The S/M mode data is used for switching between two different sorts of codebooks for the speech and for music by the VQ circuit 124. The portion $\mathbf{S16}_{vd}$ is made up of a high-range LPC data of 5 bits/160 samples and a high-range LPC residuals of 15 bits/32 samples, totalling at 80 bits/160 samples. This corresponds to a bit rate of 4 kbps. The portion $\mathbf{S16}_{ua}$ has data contents in common with the portions $\mathbf{S2}_{ua}$ and $\mathbf{S6}_{ua}$, while the portion $\mathbf{S16}_{ub}$ has data contents in common with the portions $\mathbf{S16}_{vb}$, $\mathbf{S6}_{ub}$ and $\mathbf{S6}_{vb}$. In addition, the portion $\mathbf{S16}_{uc}$ has data contents in common with the portion $\mathbf{S16}_{vc}$, while the portion $\mathbf{S16}_{ud}$ has data contents in common with the portion $\mathbf{S16}_{vd}$.

Figure 5:
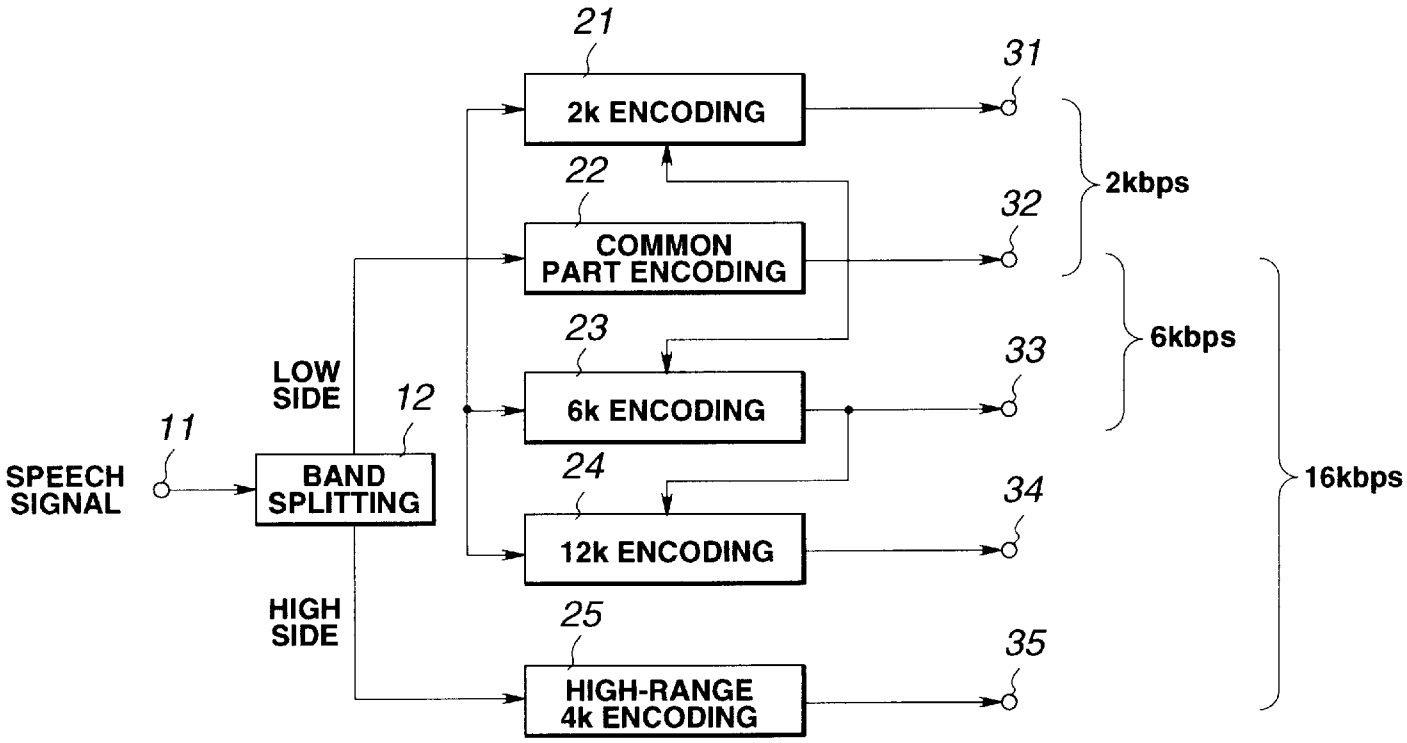
FIG. 5 is a schematic block diagram showing the entire system of the encoding side according to the present invention.

The configurations of FIGS. 1 and 3 for obtaining the above-mentioned bitstream are schematically shown in FIG. 5.

Referring to FIG. 5, an input terminal 11 corresponds to the input terminal 101 of FIGS. 1 and 3. The speech signal entering the input terminal 11 is sent to a band splitting circuit 12 corresponding to the LPF 102, sampling frequency converter 103, subtractor 106 and BPF 107 of FIG. 1 so as to be split into a low-range signal and a high-range signal. The low-range signal from the band-splitting circuit 12 is sent to a 2k encoding unit 21 and a common portion encoding unit 22 equivalent to the configuration of FIG. 3. The common portion encoding unit 22 is roughly equivalent to the LPC analysis quantization unit 130 of FIG. 1 or to the LPC analysis quantization unit 310 of FIG. 3. Moreover, the pitch extracting portion in the sinusoidal analysis encoding unit of FIG. 3 or the pitch analysis circuit 115 of FIG. 1 may also be included in the common portion encoding unit 22.

The low-range side signal from the band-splitting circuit 12 is also sent to a 6k encoding unit 23 and to a 12k encoding unit 24. The 6k encoding unit 23 and the 12k encoding unit are roughly equivalent to the circuits 111 to 116 of FIG. 1 and to the circuits 117, 118 and 122 to 128 of FIG. 1, respectively.

The high-range side signals from the band-splitting circuit 12 are sent to a high-range 4k encoding unit 25. This high-range 4k encoding unit 25 roughly corresponds to the circuits 161 to 164, 171 and 172.

The relation of the bitstreams outputted by output terminals 31 to 35 of FIG. 5 and various parts of FIG. 4 is now explained. That is, data of the portions $S2_{ve}$ or $S2_{ue}$ of FIG. 4 is outputted via output terminal 31 of the 2k encoding unit 21, while data of the portions $S2_{va}$ (=$S6_{va}$=$S16_{va}$) or $S2_{ua}$ (=$S6_{ua}$=$S16_{ua}$) of FIG. 4 is outputted via output terminal 32 of the common portion encoding unit 21. Moreover, data of the portions $S6_{vb}$ (=$S16_{vb}$) or $S6_{ub}$ (=$S16_{ub}$) of FIG. 4 is outputted via output terminal 33 of the 6k encoding unit 23, while data of the portions $S16_{vc}$ or $S16_{uc}$ of FIG. 4 is outputted via output terminal 34 of the 12k encoding unit 24, and data of the portions $S16_{vd}$ or $S16_{ud}$ of FIG. 4 is outputted via output terminal 35 of the high-range 4k encoding unit 25.

The above-described technique for realizing scalability may be generalized as follows: That is, when multiplexing a first encoded signal obtained on first encoding of an input signal and a second encoded signal obtained on second encoding of the input signal so as to have a portion in common with a part of the first encoded signal and another portion not in common with the first encoded signal, the first encoded signal is multiplexed with the portion of the second encoded signal not in common with the first encoded signal.

In this manner, if two encoding systems are essentially different encoding systems, the portions that can be treated in common are used by the two systems for achieving scalability.

The operations of the components of FIGS. 1 and 2 will be explained more specifically.

Figures 6A, 6B, 6C:
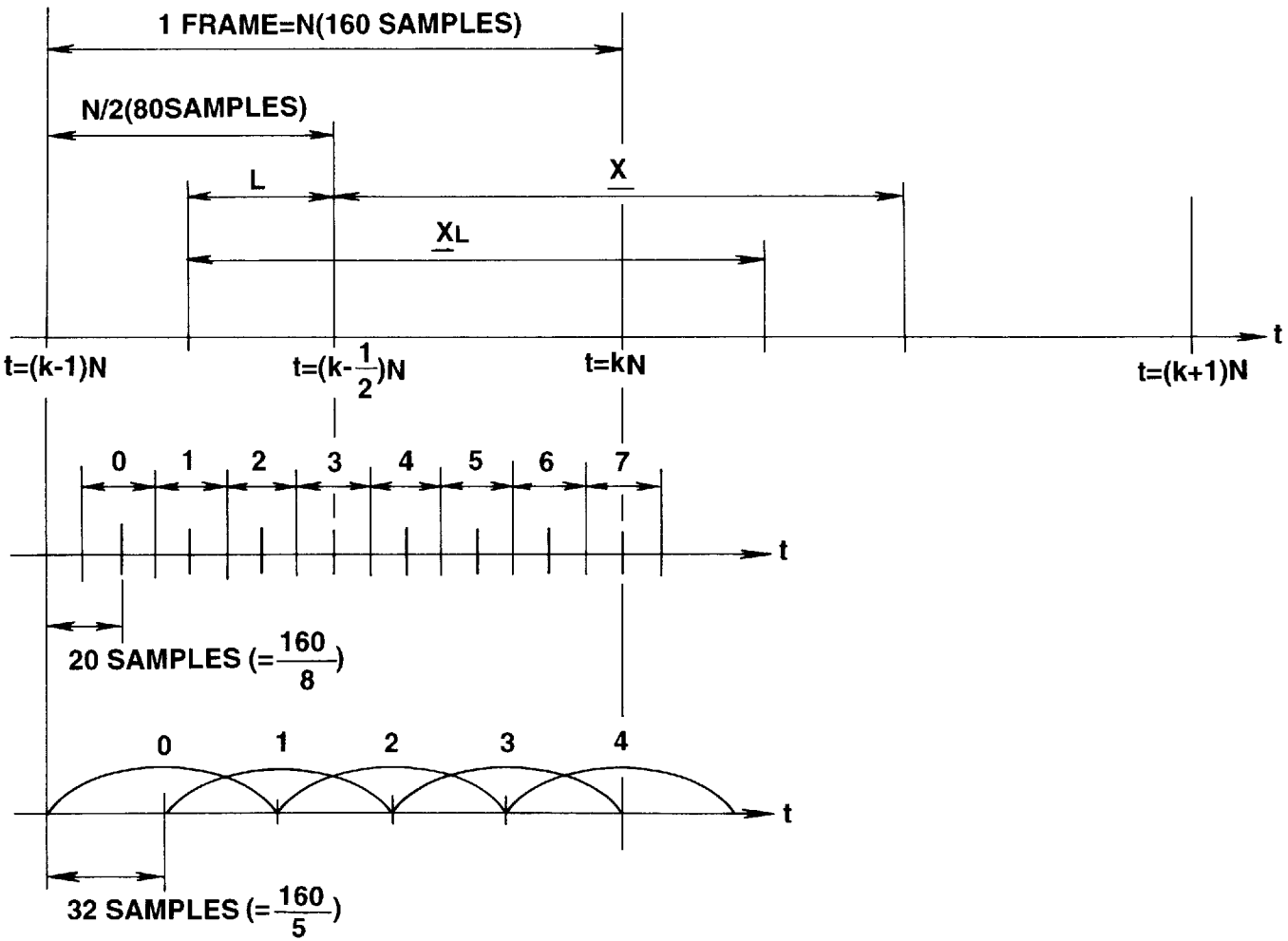
FIGS. 6A, 6B and 6C illustrate the period and the phase of main operations for encoding and decoding.

It is assumed that the frame interval is N samples, such as 160 samples, and analysis is performed once per frame, as shown in FIG. 6A.

If, with the center of pitch analysis at t=kN, where k=0, 1, 2, 3, . . . , the vector with N dimensions, made up of components present in t=kN−N/2 to kN+N/2, of the LPC prediction residuals from the LPC inverted filter 111 is X, and the vectors with N dimensions made up of components present in t=kN−N/2+L to kN+N/2−L, shifted by L samples forwardly along the time axis, are termed $X_{L.}$, $L=L_{opt.}$ is searched for minimizing $$\|X-gK_L\|^2$$

this $L_{opt}$ being used as an optimum pitch lag $L_1$ for this domain.

Alternatively, the value obtained after pitch tracking may be used as an optimum pitch lag $L_1$ for avoiding abrupt pitch changes.

Next, for this optimum pitch lag $L_1$, a set of $g_1$ minimizing $$D = \|\underline{X} - \sum_{i=-1}^{1} g_i \underline{X}_{L_{1+i}}\|^2$$

is solved for $$\frac{\partial D}{\partial g_i} = 0$$

where i=−1, 0, 1, in order to find a pitch gain vector $g_{1.}$ The pitch gain vector $g_{1.}$ is vector-quantized to give a code index $g_1$.

To further raise the prediction accuracy, the center of analysis may be made at t=(k−1/2)N. It is assumed that the pitch lag and the pitch gain for t=kN and t=(k−1)N have been found previously.

In the case of a speech signal, it may be assumed that its fundamental frequency is changed gradually, so that there is no significant change between the pitch lag L(kN) for t=kN and the pitch lag L((k−1)N) for t=(k−1)N, with the change being linear. Therefore, limitations may be imposed on the value that can be assumed by the pitch lag L((k−1/2)N) for t=(k−1/2)N. Thus, in the present embodiment, $$\begin{aligned} L((k-1/2)N) &= L(kN) \\ &= (L(kN)+L((k-1)N)/2 \\ &= L((k-1)N) \end{aligned}$$

Which of these values is used is determined by calculating the power of the pitch residuals corresponding to the respective lags.

That is, it is assumed that the vector with the number of dimensions N/2 of t=(k−1/2)N−N/4~(k−1/2)N+N/4 centered about t=(k−1/2)N is X, the vectors with the number of dimensions N/2 delayed by L(kN), (L(kN)+L((k−1)N))/2 and L((k−1)N) are $X_0^{(0)}$, $X_1^{(0)}$, $X_2^{(0)}$, respectively, and vectors in the vicinity of these vectors $X_0^{(0)}$, $X_1^{(0)}$, $X_2^{(0)}$ are $X_0^{(-1)}$, $X_0^{(1)}$, $X_1^{(-1)}$, $X_1^{(1)}$, $X_2^{(-1)}$, $X_2^{(1)}$. Also, for pitch gains $g_0$, $g_1$ and $g_2$ associated with these vectors $X_0^{(i)}$, $X_1^{(i)}$, $X_2^{(i)}$, where i=−1, 0, 1, the lag for the least one $D_j$ of $$D_0 = \|\underline{X} - \sum_i g_0^{(i)} \underline{X}_0^{(i)}\|^2$$

$$D_1 = \|\underline{X} - \sum_i g_1^{(i)} \underline{X}_1^{(i)}\|^2$$

$$D_2 = \|\underline{X} - \sum_i g_2^{(i)} \underline{X}_2^{(i)}\|^2$$

is assumed to be an optimum lag $L_2$ at t=(k−1/2)N, and the corresponding pitch gain $g_j^{(i)}$, where i=−1, 0, 1, is vector-quantized to find the pitch gain. Meanwhile, $L_2$ can assume three values, which can be found from current and past values of $L_1$. Therefore, a flag representing an interpolation scheme may be sent as an interpolation index in place of a straight value. If any one of L(kN) and L((k−1)N) is judged to be 0, that is, devoid of pitch and the pitch prediction gain cannot be obtained, the above-mentioned (L(kN)+L((k−1)N))/2 as a candidate for L((k−1/2)N) is discarded.

If the number of dimensions of the vector X used for calculating the pitch lag is reduced to one half, or to N/2, $L_k$ for t=kN as the center of analysis may be directly employed. However, the gain needs to be calculated again to transmit the resulting data, despite the fact that the pitch gain for the number of dimensions N of X is available. Here, $$g_{1d}=g_1'-\hat{g}$$

is quantized for reducing the number of bits, where $\hat{g}_1$ is the quantized pitch gain (vector) as found for the length of analysis=N and g,' is the non-quantized pitch gain as found for the length of analysis=N/2.

Of the elements ($g_0$, $g_1$, $g_2$) of the vector g, $g_1$ is largest, while $g_0$ and $g_2$ are close to zero, or vice versa, with the vector g having the strongest correlation among the three points. Thus the vector $g_{1d}$ is estimated to have smaller variance than the original vector g, such that quantization can be achieved with a smaller number of bits.

Therefore, there are five pitch parameters to be transmitted in one frame, namely $L_1$, $g_1$, $L_2$, $g_2$ and $g_{1d}$.

FIG. 6B shows the phase of the LPC coefficients interpolated with a rate eight times as high as the frame frequency. The LPC coefficients are used for calculating prediction residuals by the inverted LPC filter 111 of FIG. 1 and also for the LPC synthesis filters 215, 225 of FIG. 2 and for the pitch spectral post-filters 216, 226.

The vector quantization of pitch residuals as found from the pitch lag and from the pitch gain is now explained.

For facilitated and high-precision perceptual weighting of the vector quantization, the pitch residuals are windowed with 50% overlap and transformed with MDCT. Weighting vector quantization is executed in the resulting domain. Although the transform length may be set arbitrarily, a smaller number of dimensions is used in the present embodiment in view of the following points.

(1) If vector quantization is of a larger number of dimensions, the processing operations become voluminous, thus necessitating splitting or re-arraying in the MDCT domain.

(2) Splitting makes it difficult to perform accurate bit allocation among the bands resulting from splitting.

(3) If the number of dimensions is not a power of 2, fast operations of MDCT employing FFT cannot be used.

Since the frame length is set to 20 msec (=160 samples/8 kHz), 160/5=32=$2^5$, the MDCT transform size is set to 64 in view of 50% overlap for possibly solving the above points (1) to (3).

The state of framing is as shown in FIG. 6C.

That is, in FIG. 6C pitch residuals $r_p(n)$ in a frame of 20 msec =160 samples, where n=0, 1, . . . 191, are divided into five sub-frames, and the pitch residuals $r_{pi}(n)$ of the i'th one of the five sub-frames, where i=0, 1, . . . 4, are set to $$r_{pi}(n)=r_p(32i+n)$$

where n=160, . . . 191 implies 0, . . . 31 of the next frame. The pitch residuals $r_{pi}(n)$ of this sub-frame are multiplied with a windowing function w(n) capable of canceling the MDCT aliasing to produce $w(n)\cdot r_{pi}(n)$ which is processed with MDCT transform. For the windowing function w(n), $$w(n)=\sqrt{(1-(\cos 2\pi(n+0.5))/64)}$$

may, for example, be employed.

Since the MDCT transform is of the transform length of 64 (=$2^6$), the transform calculations may be performed using FFT by:

(1) setting $x(n)=w(n)\cdot r_{pi}\cdot\exp((-2\pi j/64)(n/2))$ (2) processing x(n) with 64-point FFT to produce y(k); and (3) taking a real part of $y(k)\cdot\exp((-2\pi j/64)(k+1/2+64/4))$ and setting the real part as a MDCT coefficient $c_j(k)$, where k=0, 1, . . . 31.

The MDCT coefficient $c_i(k)$ of each sub-frame is vector-quantized with weighting, which is now explained.

If the pitch residuals $r_{pi}(n)$ are set as a vector $L_i$, the distance following the synthesis is represented by $$\begin{aligned} D^2 &= \|H(\underline{r}_i-\hat{\underline{r}}_i)\|^2 \\ &= (\underline{r}_i-\hat{\underline{r}}_i)^t H^t H(\underline{r}_i-\hat{\underline{r}}_i) \\ &= (\underline{r}_i-\hat{\underline{r}}_i)^t M H^t H M^t M(\underline{r}_i-\hat{\underline{r}}_i) \\ &= (\underline{c}_i-\hat{\underline{c}}_i)^t M H^t H M^t(\underline{c}_i-\hat{\underline{c}}_i) \end{aligned}$$

where H is a synthesis filter matrix, M is a MDCT matrix, $c_i$ is a vector representation of $c_j^{(k)}$ and $\hat{c}_i$ is a vector representation of quantized $\hat{c}_j^{(k)}$.

Since M is used to diagonalize $H^tH$, where $H^t$ is a transposed matrix of H, by its properties, $$MH^tHM=\begin{bmatrix} h_0^2 & & & & \\ & h_1^2 & 0 & & \\ & & \cdot & & \\ & 0 & & \cdot & \\ & & & & \cdot \\ & & & & h_{n-1}^2 \end{bmatrix}$$

where n=64 and $h_i$ is set as a frequency response of the synthesis filter. Therefore, $$D^2=\sum_k h_k^2(c_i(k)-\hat{c}_i(k))^2$$

If $h_k$ is directly used for weighting for quantizing c (k), the noise after synthesis becomes flat, that is 100% noise shaping is achieved. Thus the perceptual weighting W is used for controlling so that the format will become a noise of a similar shape.

$$W=\begin{bmatrix} w_0 & & & & \\ & w_1 & 0 & & \\ & & \cdot & & \\ & 0 & & \cdot & \\ & & & & \cdot \\ & & & & w_{n-1} \end{bmatrix}$$

$(n=64)$

Meanwhile, $h_i^2$ and $w_i^2$ may be found as an FFT power spectrum of the impulse response $$H(z)=\frac{1}{1+\sum_{j=1}^{P}\alpha_{ij}Z^{-j}}$$

$$W(z)=\frac{1+\sum_{j=1}^{P}\lambda_b^j\alpha_{ij}Z^{-j}}{1+\sum_{j=1}^{P}\lambda_a^j\alpha_{ij}Z^{-j}}$$

of the synthesis filter H(z) and the perceptual weighting filter W(z) where P is the number of analysis and $\lambda_a$, $\lambda_b$ are coefficients for weighting.

In the above equations, $\alpha_{ij}$ is an LPC coefficient corresponding to the i'th sub-frame and may be found from the interpolated LPC coefficient. That is, $LSP_0(j)$ obtained by the analysis of the previous frame and $LSP_1(j)$ of the current frame are internally divided and, in the present embodiment, the LSP of the i'th sub-frame frame is set to $$LSP^{(i)}(j) = \left(1 - \frac{i+1}{5}\right) LSP_0(j) + \frac{i+1}{5}\ LSP_1(j)$$

where i=0, 1, 2, 3, 4, to find $LSP^{(i)}(j)$. $\alpha_{(ij)}$ is then found by LSP to $\alpha$ conversion.

For H and W, thus found, W' is set so as to be equal to WH (W'=WH) for use as a measure of the distance for vector quantization.

The vector quantization is performed by shape and gain quantization. The optimum encoding and decoding conditions during learning are now explained.

If the shape codebook at a certain time point during learning is s, the gain codebook is g, the input during training, that is, the MDCT coefficient in each sub-frame is x, and the weight for each sub-frame is W', the power $D^2$ for the distortion at this time is defined by the following equation:

$$D^2 = \|W'(x - gs)\|$$

The optimum encoding condition is selection of (g, s) which will minimize $D^2$.

$$\begin{aligned} D^2 &= (\underline{x} - g\underline{s})^t w'^t w'(\underline{x} - g\underline{s}) \\ &= \underline{s}^t w'^t w' \underline{s} \left( g - \frac{\underline{s}^t w'^t w' \underline{x}}{\underline{s}_t w'^t w \underline{s}} \right)^2 + \underline{x}^t w'^t w' \underline{x} - \frac{(\underline{s}^t w'^t w' \underline{x})^2}{\underline{s}^t w'^t w' \underline{s}} \end{aligned}$$

Therefore, as a first step, $s_{opt}$ which maximizes $$\frac{(\underline{s}^t w'^t w' \underline{x})^2}{\underline{s}^t w'^t w' \underline{s}}$$

is searched for in the shape Cod ebook and $g_{opt}$ closest to $$\frac{\underline{s}^t opt w'^t w' \underline{x}}{\underline{s}^t opt w'^t w' \underline{s} opt}$$

is searched for in the gain codebook for this $s_{opt}$.

Next, the optimum decoding condition is found.

As the second step, since the sum $E_s$ for the distortion for a set $x_k$ (k=0, . . . , N−1) of x encoded in the shape codebook s at a certain point during learning is $$E_s = \sum_{k=0}^{N-1} \|w_k'(\underline{x}_k - g_k \underline{s})\|^2$$

s which minimizes the sum is found by $$\frac{\partial E_s}{\partial \underline{s}} = 0$$

as $$\underline{s} = \left( \sum_{k=0}^{N-1} g_k^2 w_k'^t w_k' \right)^{-1} \Sigma\, g_k w_k'^t w_k' \underline{x}_k$$

As for the gain codebook, the sum of the distortion $E_g$ of a set $x_k$ with a weight $W_k'$ and the shape s of x encoded in the gain codebook g is $$E_g = \sum_{k=0}^{N-1} \|w_k'(\underline{x}_k - g\underline{s}_k)\|^2$$

so that, from $$\frac{\partial E}{\partial g} = 0$$

$$g = \frac{\sum_{k=0}^{M-1} \underline{s}_k^t w_k'^t w_k' \underline{x}_k}{\sum_{k=0}^{M-1} \underline{s}_k^t w_k'^t w_k' \underline{s}_k}$$

The shape and gain codebooks may be produced by the generalized LLoyd algorithm while the above first and second steps are found repeatedly.

Since importance is attached to the noise for the low signal level in the present embodiment, learning is executed using W'/||x|| weighted with a reciprocal of the level, in place of W' itself.

Figure 7A:
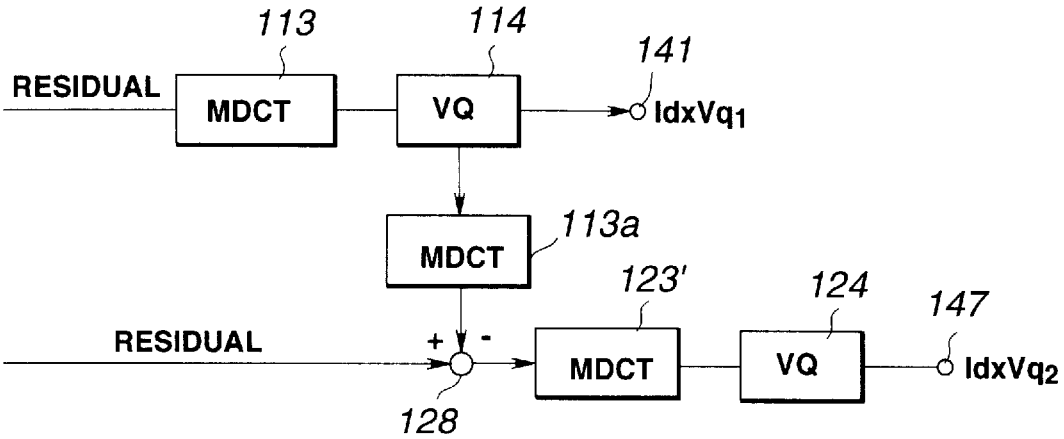
FIGS. 7A and 7B illustrate vector quantization of MDCT coefficients .
Figure 7B:
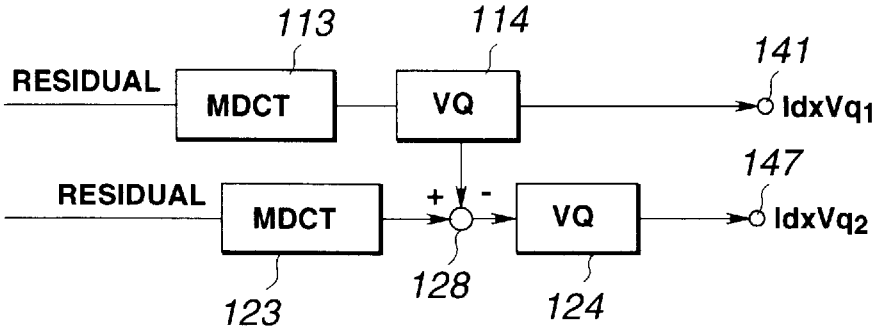

The MDCTed pitch residuals are vector-quantized, using the codebook thus prepared, and the index thereby obtained is transmitted along with the LPC (in effect LSP), pitch and the pitch gain. The decoder side executes inverse VQ and pitch-LPC synthesis to produce the reproduced sound. In the present embodiment, the number of times the pitch gain calculations are performed is increased and the pitch residual MDCT and vector quantization are executed in multiple stages for enabling a higher rate operation. An illustrative example is shown in FIG. 7A, in which the number of stages is two and the vector quantization is sequential multi-stage VQ. An input to the second stage is the decoded result of the first stage subtracted from pitch residuals of higher precision produced from $L_2$, $g_2$ and $g_{1d}$. That is, an output of the first-stage MDCT circuit 113 is vector-quantized by the VQ circuit 114 to find the representative vector or a dequantized output which is inverse MDCTed by an inverse MDCT circuit 113*a*. The resulting output is sent to a subtractor 128' for subtraction from the residuals of the second stage (output of the inverted pitch filter 122 of FIG. 1). An output of the subtractor 128' is sent to a MDCT circuit 123' and the resulting MDCTed output is quantized by the VQ circuit 124. This can be configured similarly to the equivalent configuration of FIG. 7B in which MDCT is not performed. FIG. 1 uses the configuration of FIG. 7B.

If decoding by the decoder shown in FIG. 2 is performed using both of the indices $I_{dx}V_{q1}$ and $I_{dx}V_{q2}$ of the MDCT coefficients, the sum of results of inverse VQ of the indices $I_{dx}V_{q1}$ and $I_{dx}V_{q2}$ is inverse MDCTed and overlap-added. Subsequently, pitch synthesis and LPC synthesis are performed to produce the reproduced sound. Of course, the pitch lag and pitch gain updating frequency during pitch synthesis is twice that of the single stage configuration. Thus, in the present invention, the pitch synthesis filter is driven as it is changed over every 80 samples.

The post-filters 216, 226 of the decoder of FIG. 2 are now further explained.

The post-filters realize post-filter characteristics p(Z) by pitch emphasis, high range emphasis and a tandem connection of spectrum emphasis filters.

$$P(z)=\frac{i}{1-\gamma_p\sum_{i=-1}^{1}g_i z^{-L+1}}(1-\gamma_b z^{-1})\frac{1-\sum_{j=1}^{P}\gamma_n{}^j\alpha_{ij}Z^{-j}}{1-\sum_{j=1}^{P}\gamma_d{}^j\alpha_{ij}Z^{-j}}$$

In the above equation, $g_i$ and L are the pitch gain and the pitch lag as found by pitch prediction, while ν is a parameter specifying the intensity of pitch emphasis, such as ν=0.5. On the other hand, $\nu_b$ is a parameter specifying high-range emphasis, such as $\nu_b$=0.4, while $\nu_n$ and $\nu_d$ are parameters specifying the intensity of spectrum emphasis, such as $\nu_n$=0.5, $\nu_d$=0.8.

The gain correction is then made on the output s(n) of the LPC synthesis filter and the output $s_p(n)$ of the post-filter with the coefficient $k_{adj}$ such that $$k_{adj}=\frac{\sum_{i=0}^{N-1}(s(n))^2}{\sum_{i=0}^{N-1}(s_p(n))^2}$$

where N=80 or 160. Meanwhile, $k_{adj}$ is not fixed in a frame and is varied on the sample basis after being passed through the LPF. For example, p equal to 0.1 is used.

$$k_{adj}(n)=(1-p)k_{adj}(n-1)+pk_{adj}$$

For smoothing the junction between frames, two pitch emphasis filters are used, and the cross-faded result of the filtering is used as an ultimate output.

$$\frac{1}{1-\gamma_p\sum_{i=-1}^{1}g_{0i}z^{-L0+i}}$$

$$\frac{1}{1-\gamma_p\sum_{i=-1}^{1}g_j z^{-L+i}}$$

Figure 8A:
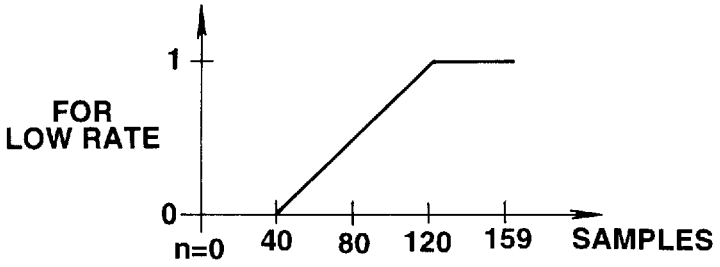
FIGS. 8A and 8B illustrate examples of windowing functions applied to a post-filter output.
Figure 8B:
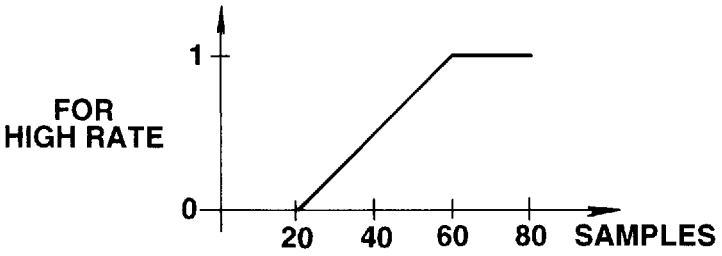

For the outputs $s_{p0}(n)$ and ${}_ps$ (n) of the post-filter, thus configured, an ultimate output $s_{out}(n)$ is $$s_{out}(n)=(1-f(n))\cdot s_{p0}(n)\cdot{}_ps(n)$$

where f(n) is a window shown for example in FIG. 8. FIGS. 8A and 8B show the windowing functions for the low-rate operation and for the high-rate operation, respectively. The window with a width of 80 samples of FIG. 8B is used twice during synthesis of 160 samples (20 msec).

The encoder side VQ circuit 124 shown in FIG. 1 is now further explained.

This VQ circuit 124 has two different sorts of codebooks for speech and for music switched and selected responsive to the input signal. That is, if the quantizer configuration is fixed for quantization of musical sound signals, the codebook used by the quantizer becomes optimum with the properties of the speech and the musical sound as used during learning. Thus, if the speech and the musical sound are learned together, and if the two are significantly different in their properties, the as-learned codebook has an average property of the two, as a result of which the performance or mean S/N value may be presumed not to be raised in the case that the quantizer is configured with a single codebook.

Thus, in the present embodiment, the code volumes prepared using the learning data for plural signals having different properties are switched for improving the quantizer performance.

Figure 9:
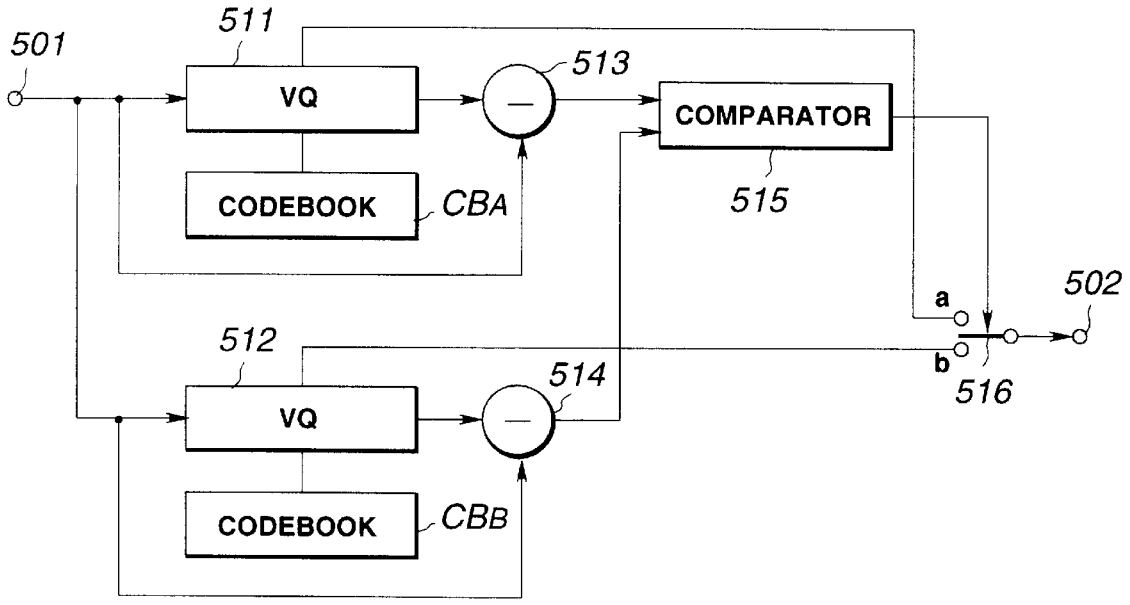
FIG. 9 shows an illustrative vector quantization device having two sorts of codebooks.

FIG. 9 shows a schematic structure of a vector quantizer having such two different of codebooks $CB_A$, $CB_B$.

Referring to FIG. 9, an input signal supplied to an input terminal 501 is sent to vector quantizers 511, 512. These vector quantizers 511, 512 use codebooks $CB_A$, $CB_B$. The representative vectors or dequantized outputs of the vector quantizers 511, 512 are sent to subtractors 513, 514, respectively, where the difference from the original input signal are found to produce error components which are sent to a comparator 515. The comparator 515 compares the error components and selects an index which is a smaller one of quantization outputs of the vector quantizers 511, 512 by a changeover switch 516. The selected index is sent to an output terminal 502.

The switching period of the changeover switch 516 is selected to be longer than the period or the quantization unit time of each of the vector quantizers 511, 512. For example, if the quantization unit is a sub-frame obtained by dividing a frame into eight, the changeover switch 516 is changed over on the frame basis.

It is assumed that the codebooks $CB_A$, $CB_B$, having learned only the speech and only the musical sound, respectively, are of the same size N and of the same number of dimensions M. It is also assumed that, when the L-dimension data X made up of L data of a frame is vector-quantized with a sub-frame length M (=L/n), the distortion following the quantization is $E_A(k)$ and $E_B(k)$ if the codebooks $CB_A$, $CB_B$ are used, respectively. If the indices i and j are selected, these distortions $E_A(k)$ and $E_B(k)$ are represented by:

$$E_A(k)=\|W_k(X-C_{Ai})\|$$

$$E_B(k)=\|W_k(X-C_{Bi})\|$$

where $W_k$ is a weighted matrix at the sub-frame $k_{Aj}$ and $C_{Bj}$, C denote representative vectors associated with the indices i and j of the codebooks $CB_A$, $CB_B$, respectively.

As for the two distortions, thus obtained, the codebook most appropriate for a given frame is used by the sum of the distortion in the frame. The following two methods may be used for such selection.

The first method is to perform quantization using only the codebooks $CB_A$, $CB_B$, to find the sum of the distortions in the frame $\Sigma_k E_A(k)$ and $\Sigma_{k\ EB}$ (k) and to use the codebook $CB_A$ or $CB_B$ which gives a smaller one of the sums of the distortion for the entire frame.

Figure 10:
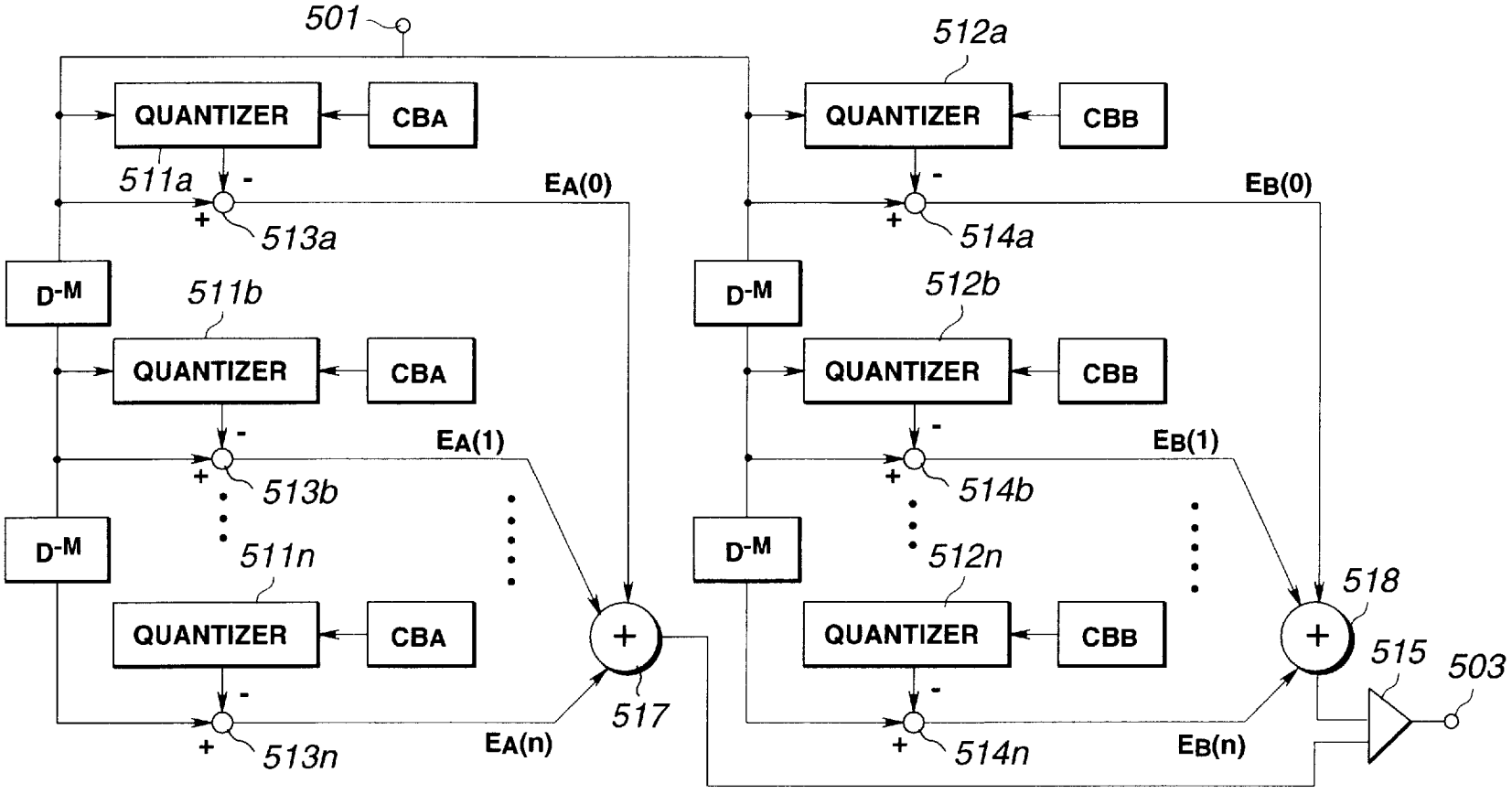
FIG. 10 is a block diagram showing a detailed structure of a vector quantization apparatus having two sorts of codebooks.

FIG. 10 shows a configuration for implementing the first method, in which the parts or components corresponding to those shown in FIG. 9 are denoted by the same reference numerals and suffix letters such as a, b, . . . correspond to the sub-frame k. As for the codebook $CB_A$, the sum for the frame of outputs of subtractors 513*a*, 513*b*, . . . 513*n*, which give the sub-frame-based distortions, is found at an adder 517. As for the codebook $CB_B$, the sum for the frame of the sub-frame-based-distortions is found at an adder 518. These sums are compared to each other by the comparator 515 for obtaining a control signal or a selection signal for codebook switching at the terminal 503.

The second method is to compare the distortions $E_A(k)$ and $E_B(k)$ for each sub-frame and to evaluate the results of comparison for the totality of sub-frames in the frame for switching codebook selection.

Figure 11:
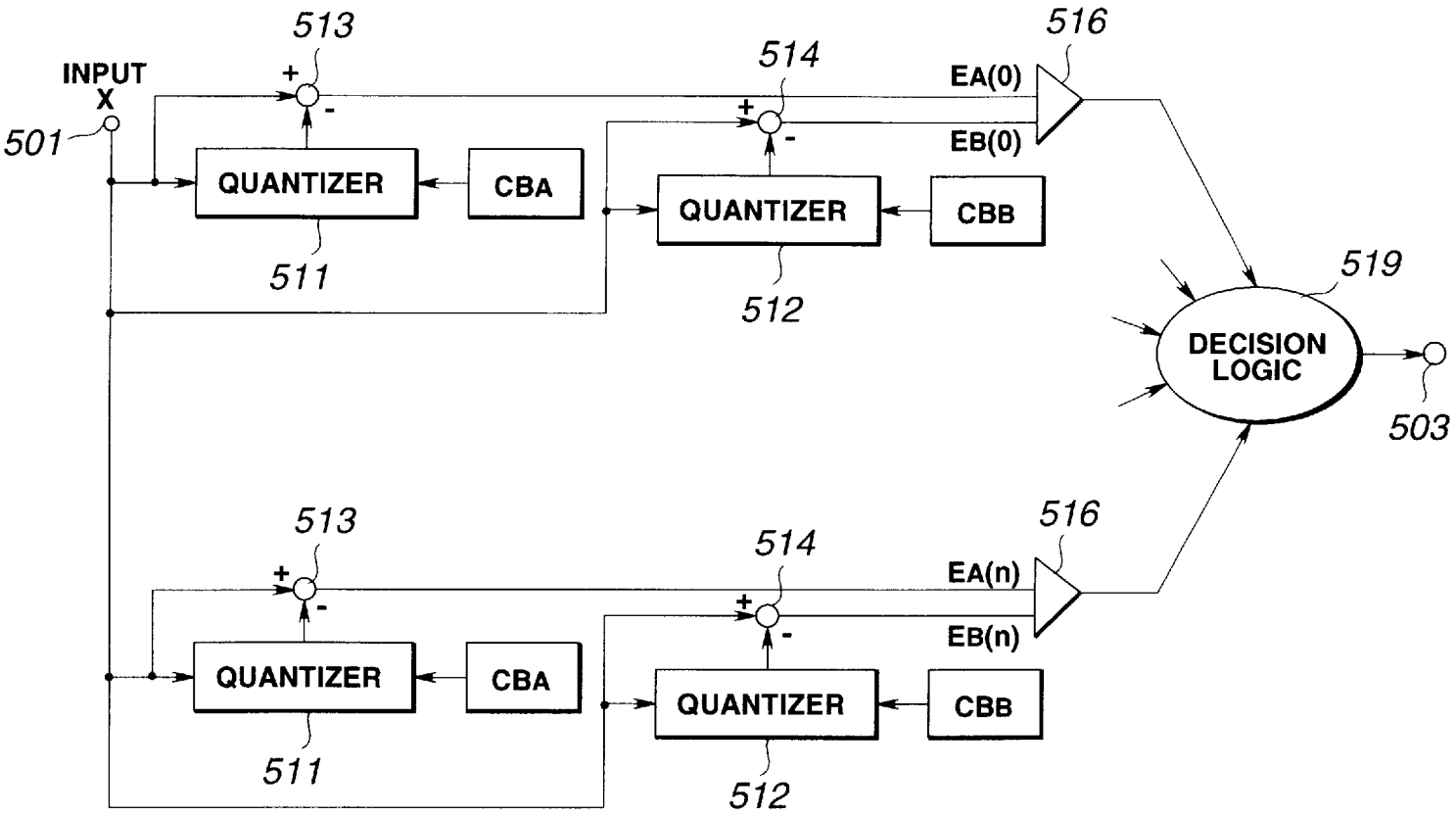
FIG. 11 is a block diagram showing another detailed structure of a vector quantization apparatus having two sorts of codebooks.

FIG. 11 shows a configuration for implementing the second method, in which an output of the comparator 516 for sub-frame-based comparison is sent to judgment logic 519 for giving judgment by majority decision for producing a one-bit codebook switching selection flag at a terminal 503.

This selection flag is transmitted as the above-mentioned S/M (speech/music) mode data.

In this manner, plural signals of different properties can be efficiently quantized using a sole quantizer.

The frequency conversion operation by the FFT unit 161, frequency shifting circuit 162 and the inverse FFT circuit 163 of FIG. 1 is now further explained.

The frequency conversion processing includes a band extraction step of taking out at least one band of the input signal, an orthogonal transform step of transforming the signal of at least one extracted band into frequency-domain signal, a shifting step of shifting the orthogonal transformed signal on the frequency domain to another position or band, and an inverse orthogonal transform step of converting the signal shifted on the frequency domain by inverse orthogonal transform into time-domain signals.

Figure 12:
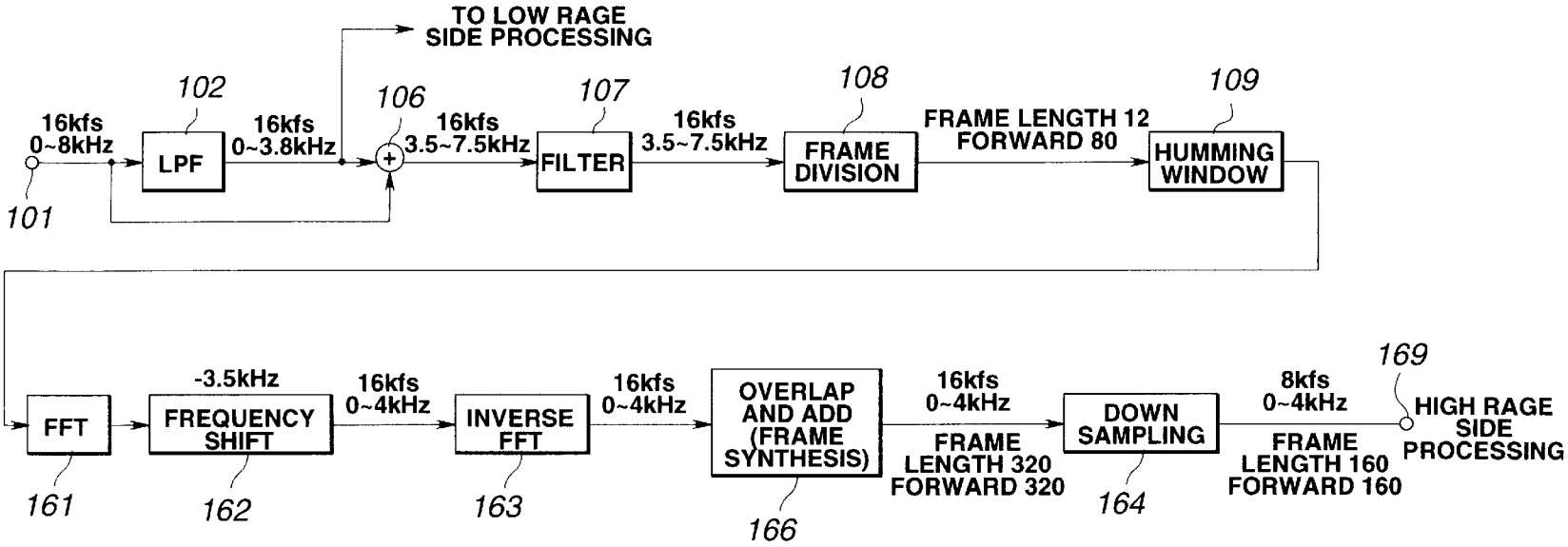
FIG. 12 is a block diagram showing the structure of an encoder for frequency conversion.

FIG. 12 shows the structure for the above-mentioned frequency transform in more detail. In FIG. 12, parts or components corresponding to those of FIG. 1 are denoted by the same numerals. In FIG. 12, broad-range speech signals having components of 0 to 8 kHz with the sampling frequency of 16 kHz are supplied to the input terminal 101. Of the broad-band speech signal from the input terminal 101, the band of 0 to 3.8 kHz, for example, is separated as the low-range signal by the low-pass filter 102, and the remaining frequency components obtained by subtracting the low-range side signal from the original broad-band signal by the subtractor 151 is separated as the high-frequency component. These low-range and high-range signals are processed separately.

The high-range side signal has a frequency width of 4.5 kHz in a range from 3.5 kHz to 8 kHz, which is still left after passage through the LPF 102. This bandwidth needs to be reduced to 4 kHz in view of signal processing with down-sampling. In the present embodiment, the band of 0.5 kHz ranging from 7.5 kHz to 8 kHz is cut by a band-pass filter (BPF) 107 or an LPF.

Then, fast Fourier transform (FFT) is used for frequency conversion to a lower range side. However, prior to FFT, the number of samples is divided at an interval of a number of samples equal to powers of 2, for example, 512 samples, as shown for example in FIG. 13A. However, the samples are advanced every 80 samples for facilitating the subsequent processing.

Figures 13A, 13B:
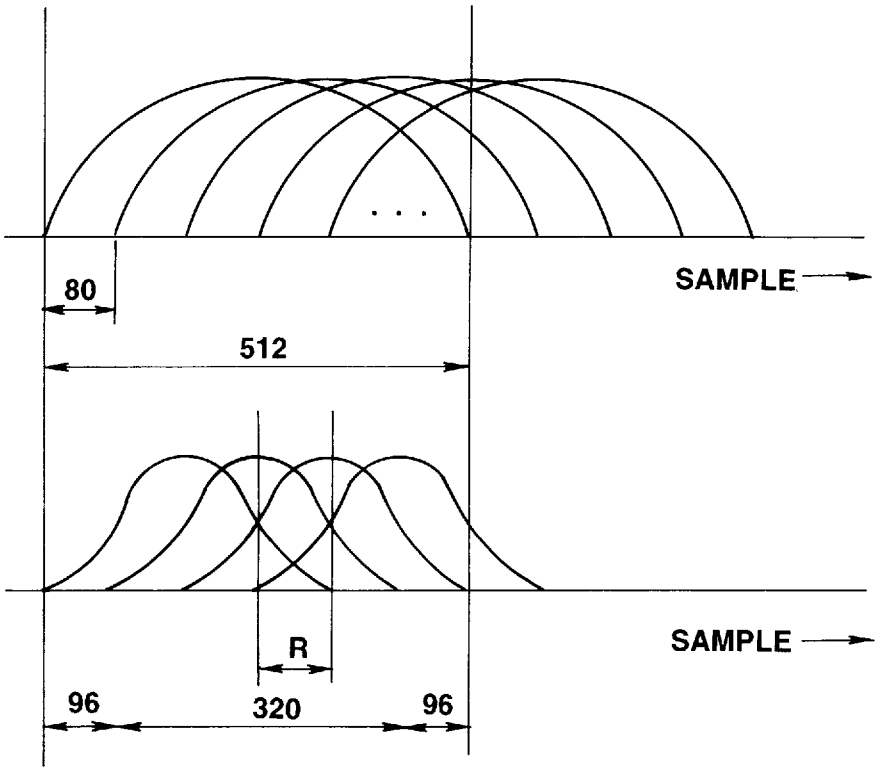
FIGS. 13A, 13B illustrate frame splitting and overlap-and-add operations.

A Hamming window of a length of 320 samples is then applied by a Hamming windowing circuit 109. The number of samples of 320 is selected to be four times as large as 80, which is the number by which the samples arc advanced at the time of frame division. This enables four waveforms to be added later on in superimposition at the time of frame synthesis by overlap-and-add as shown in FIG. 13B.

The 512-sample data is then FFTed by the FFT circuit 161 for conversion into frequency-domain data.

Figure 14A:
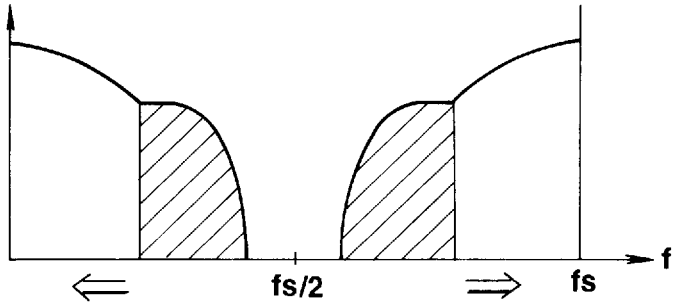
FIGS. 14A, 14B and 14C illustrate an example of frequency shifting on the frequency axis.
Figure 14B:
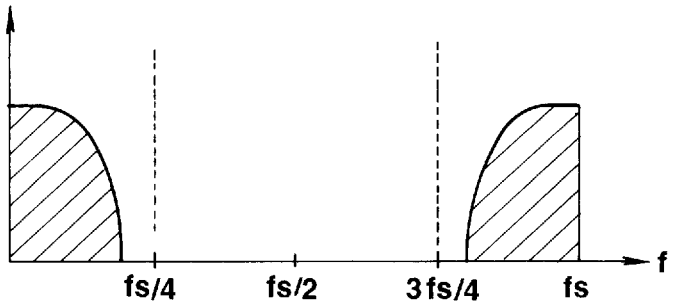
Figure 14C:
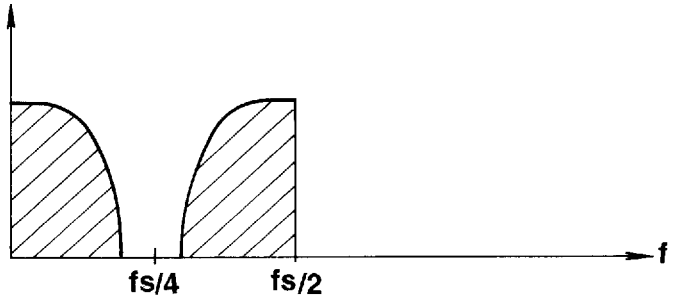

The frequency-domain data is then shifted by the frequency shifting circuit 162 to another position or to an other range on the frequency axis. The principle of lowering the sampling frequency by this shifting on the frequency axis is to shift the high-range side signal shown shaded in FIG. 14A to a low-range side as indicated in FIG. 14B and to down-sample the signal as shown in FIG. 14C. The frequency components aliased with fs/2 as the center at the time of shifting on the frequency axis from FIG. 14A to FIG. 14B are shifted in the opposite direction. This enables the sampling frequency to be lowered to fs/n if the range of the sub-band is lower than fs/2n.

Figure 15A:
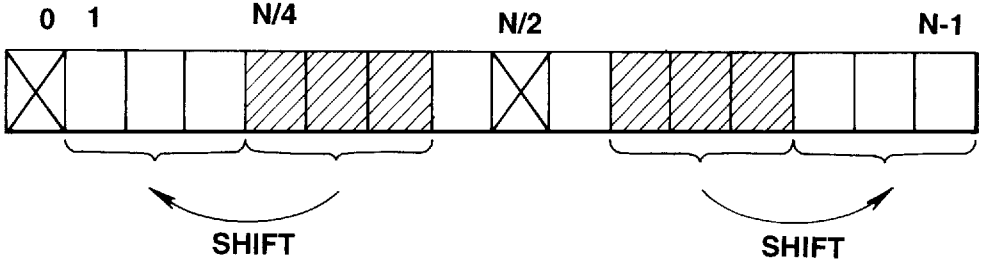
FIGS. 15A and 15B illustrate data shifting on the frequency axis.

It suffices for the frequency shifting circuit 162 to shift high-range side frequency-domain data, shown shaded in FIG. 15, to a low-range side position or band on the frequency axis. Specifically, 512 frequency-domain data, obtained on FFTing 512 time-domain data, are processed so that 127 data, namely 113rd to 239th data, are shifted to the first to 127th positions or bands, respectively, while 127 data, namely 273rd to 399th data, are shifted to the 395th to 511th positions or bands, respectively. At this time, it is critical that the 112th frequency-domain data be not shifted to the 0th position or band. The reason is that the 0th data of the frequency-domain signal is a dc component and devoid of a phase component so that data at this position needs to be a real number, such that the frequency component, which is generally a complex number, cannot be introduced in this position. Moreover, the 256th data representing fs/2, generally the N/2nd data, is also invalid and is not used. That is, the range of 0 to 4 kHz should more correctly be represented as $0<f<4$ kHz.

The shifted data is inverse FFTed by the inverse FFT circuit 163 for restoring the frequency-domain data to time-domain data. This gives time-domain data every 512 samples. These 512-sample-based time-domain signals are overlapped by the overlap-and-add circuit 166 every 80 samples, as shown in FIG. 13B, for summing the overlapped portions.

The signal obtained by the overlap-and add circuit 166 is limited by 16 kHz sampling to 0 to 4 kHz and hence is down-sampled by the down-sampling circuit 164. This gives a signal of 0 to 4 kHz by frequency shifting with 8 kHz sampling. This signal is taken out at an output terminal 169 and hence supplied to the LPC analysis quantization unit 130 and to the LPC inverted filter 171 shown in FIG. 1.

Figure 16:
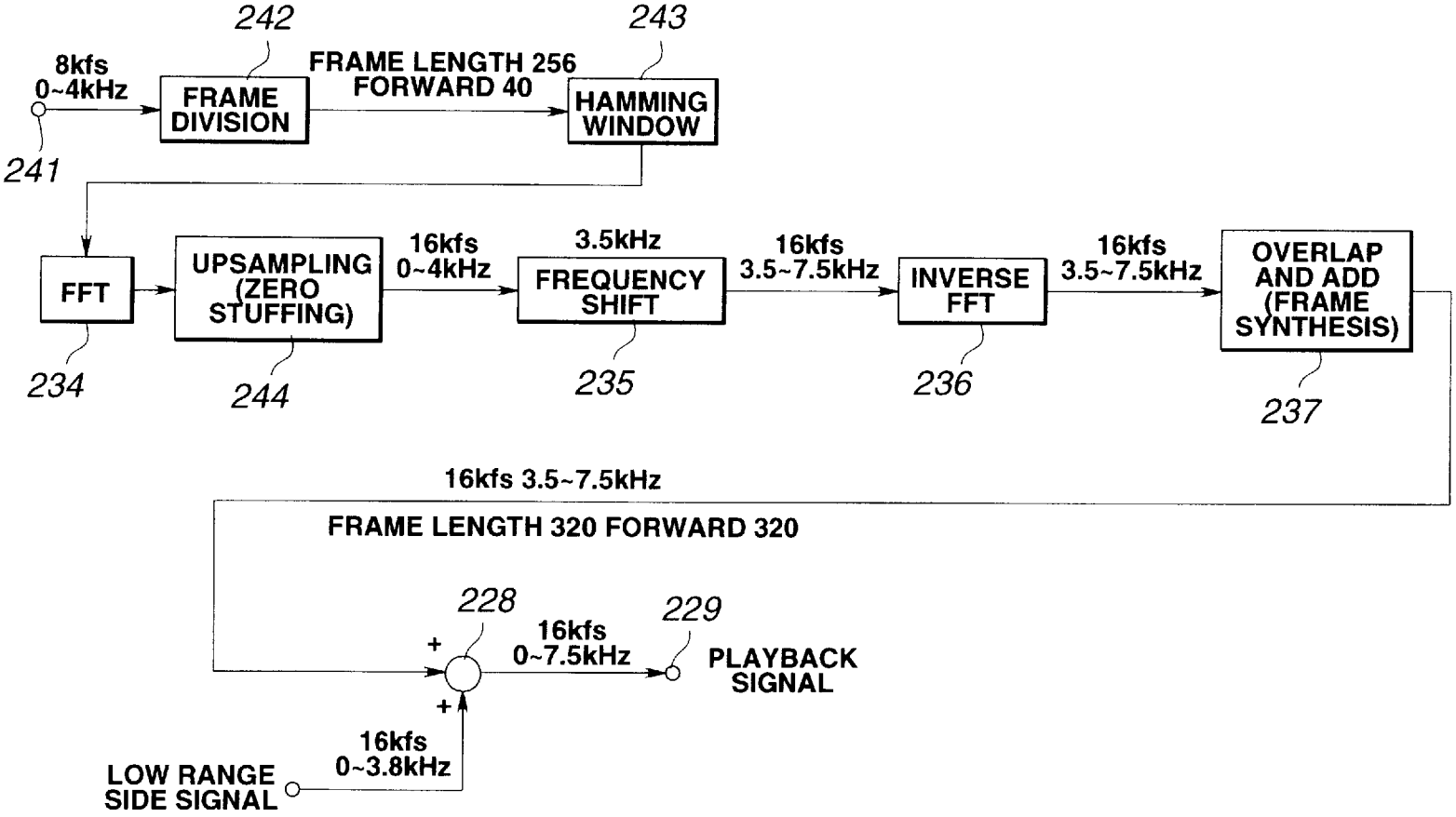
FIG. 16 is a block diagram showing the structure of a decoder for frequency conversion.

The decoding operation on the decoder side is implemented by a configuration shown in FIG. 16.

The configuration of FIG. 16 corresponds to the configuration downstream of the up-sampling circuit 233 in FIG. 2 and hence the corresponding portions are indicated by the same numerals. Although FFT processing is preceded by up-sampling in FIG. 2, FFT processing is followed by up-sampling in the embodiment of FIG. 16.

In FIG. 16, the high-range side signal shifted to 0 to 4 kHz by 8 kHz sampling, such as an output signal of the high-range side LPC synthesis filter 232 of FIG. 2, is supplied to the terminal 241 of FIG. 16.

This signal is divided by the frame dividing circuit 242 into signals having a frame length of 256 samples, with an advancing distance of 80 samples, for the same reason as that for frame division on the encoder side. However, the number of samples is halved because the sampling frequency is halved. The signal from the frame division circuit 242 is multiplied by a Hamming windowing circuit 243 with a Hamming window 160 samples long in the same way as for the encoder side (the number of samples is, however, one-half).

Figure 15B:
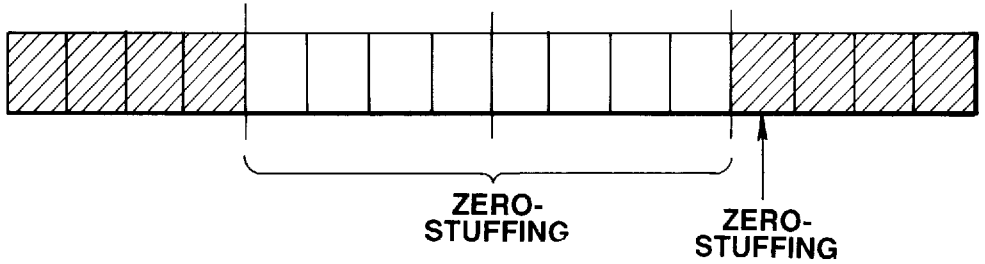

The resulting signal is then FFTed by the FFT circuit 234 with a length of 256 samples for converting the signal from the time axis into frequency axis. The next up-sampling circuit 244 provides a 512-sample frame length from the frame length of 216 samples by zero-stuffing as shown in FIG. 15B. This corresponds to conversion from FIG. 14C to FIG. 14B.

The frequency shifting circuit 235 then shifts the frequency-domain data to another position or band on the frequency axis for frequency shifting by +3.5 kHz. This corresponds to conversion from FIG. 14B to FIG. 14A.

The resulting frequency-domain signals are inverse FFTed by the inverse FFT circuit 236 for restoration to time-domain signals. The signals from the inverse FFT circuit 236 range from 3.5 kHz to 7.5 kHz with 16 kHz sampling.

The next overlap-and-add circuit 237 overlap-adds the time-domain signals every 80 samples, for each 512-sample frame, for restoration to continuous time-domain signals. The resulting highrange side signal is summed by the adder 228 to the low-range side signal and the resulting sum signal is outputted at the output terminal 229.

For frequency conversion, specific figures or values are not limited to those given in the above-described embodiments. Moreover, the number of bands is not limited to one.

Figure 17A:
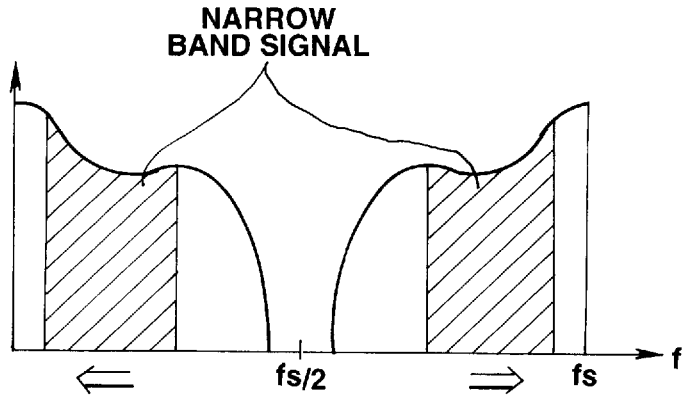
FIGS. 17A, 17B and 17C illustrate another example of frequency shifting on the frequency axis.
Figure 17B:
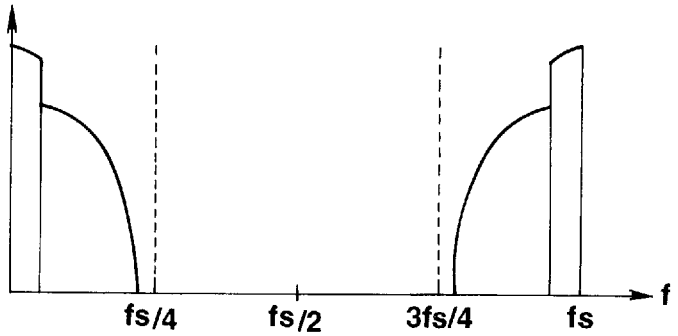
Figure 17C:
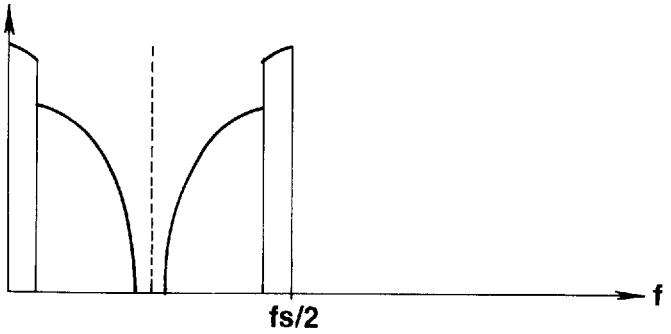

For example, if the narrow band signals of 300 Hz to 3.4 kHz and the broad-band signals of 0 to 7 kHz are produced by 16 kHz sampling, as shown in FIG. 17, the low-range signal of 0 to 300 Hz is not contained in the narrow band. The high-range side of 3.4 kHz to 7 kHz is shifted to a range of 300 Hz to 3.9 kHz so as to be contacted with the low-range side, the resulting signal ranges from 0 to 3.9 kHz, so that the sampling frequency fs may be halved, that is, may be 8 kHz.

In more generalized terms, if a broad-band signal is to be multiplexed with a narrow-band signal contained in the broad-band signal, the narrow-band signal is subtracted from the broad-band signal and high-range components in the residual signal are shifted to the low-range side for lowering the sampling rate.

In this manner, a sub-band of an arbitrary frequency may be produced from another arbitrary frequency and processed with a sampling frequency twice the frequency width for flexibly coping with given applications.

Conventionally, if the quantization error is larger due to low bit rate, the aliasing noise is usually generated in the vicinity of the band division frequency with the use of a QMF. Such aliasing noise can be evaded with the present method for frequency conversion.

Figure 18:
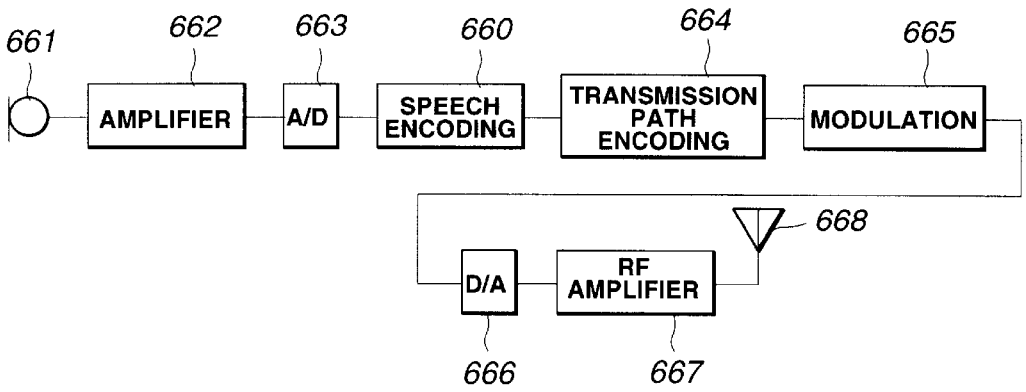
FIG. 18 is a block diagram showing the structure of a transmitting side of a portable terminal employing a speech encoding apparatus of the present invention.
Figure 19:
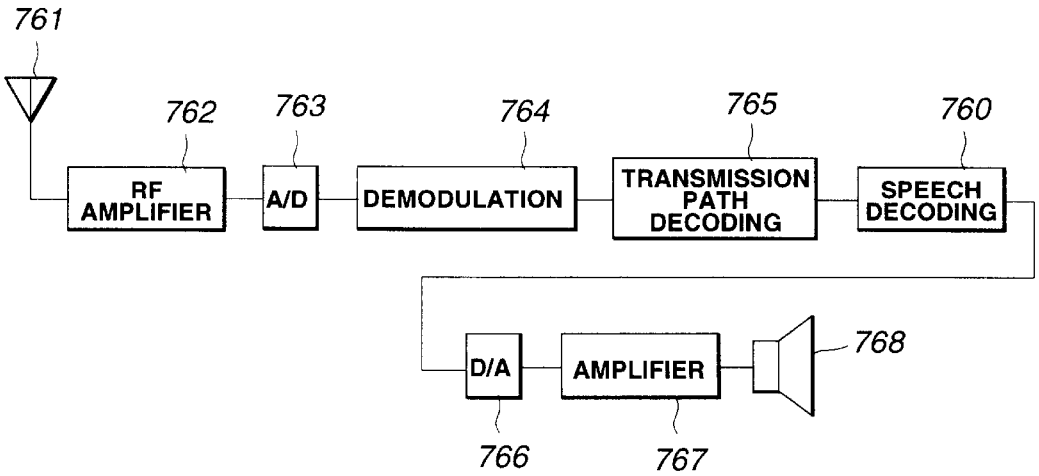
FIG. 19 is a block diagram showing the structure of a receiving side of a portable terminal employing a speech signal decoding apparatus associated with FIG. 18.

The above-described signal encoder and decoder may be used as a speech codec used in a portable communication terminal or a portable telephone as shown for example in FIGS. 18 and 19.

FIG. 18 shows the configuration of a sender of the portable terminal employing a speech encoding unit 160 configured as shown for example in FIG. 1 and FIG. 3. The speech signal collected by a microphone 661 in FIG. 18 is amplified by an amplifier 662 and converted by an A/D converter 663 into a digital signal which is sent to a speech encoding unit 660. This speech encoding unit 660 is configured as shown in FIGS. 1 and 3. To the input terminal 101 of the encoding unit 660 is supplied the digital signal from the A/D converter 663. The speech encoding unit 660 performs encoding as explained in connection with FIGS. 1 and 3. Output signals of the output terminals of FIGS. 1 and 3 are sent as output signals of the speech encoding unit 660 to a transmission path encoding unit 664 where channel decoding is performed and the resulting output signals are sent to a modulation circuit 665 and modulated so as to be sent via a D/A converter 666 and an RF amplifier 667 to an antenna 668.

FIG. 19 shows a configuration of a receiving side of the portable terminal employing a speech decoding unit 760 configured as shown in FIG. 2. The speech signal received by the antenna 761 of FIG. 19 is amplified by an RF amplifier 762 and sent via an A/D converter 763 to a demodulation circuit 764 so that demodulated signals are supplied to a transmission path decoding unit 765. An output signal of the demodulation circuit 764 is sent to a speech decoding unit 760 configured as shown in FIG. 2. The speech decoding unit 760 performs signal decoding as explained in connection with FIG. 2. An output signal of an output terminal 201 of FIG. 2 is sent as a signal of the speech decoding unit 760 to a D/A converter 766. An analog speech signal from the D/A converter 766 is sent via an amplifier 767 to a speaker 768.

The present invention is not limited to the above-described embodiments. For example, the configuration of the speech encoder of FIG. 1 or the configuration of the speech decoder of FIG. 2, represented by hardware, may also be implemented by a software program using a digital signal processor (DSP). Also, plural frames of data may be collected and quantized with matrix quantizations instead of with vector quantization. In addition, the speech encoding or decoding method according to the present invention is not limited to the particular configuration described above. Also, the present invention may be applied to a variety of usages such as pitch or speed conversion, computerized speech synthesis, or noise suppression, without being limited to transmission or recording/reproduction.

What is claimed is:

1. A signal encoding method comprising the steps of:

splitting an input signal into a plurality of frequency bands;

encoding signals of said each of the plurality of frequency bands in respective manners depending on signal characteristics of said each of the plurality of frequency bands;

splitting the input speech signal into a first frequency band and a second frequency band, said second frequency band being lower on the frequency spectrum than the first frequency band;

performing a short-term prediction on the signals of the second frequency band for finding short-term prediction residuals;

performing a long-term prediction on the short-term prediction residuals for finding long-term prediction residuals; and orthogonal-transforming the long-term prediction residuals using a modified discrete cosine transform for the orthogonal transform step with a predetermined transform length selected to be a power of 2.

2. The signal encoding method as claimed in claim 1, wherein said step of splitting includes splitting an input speech signal having a frequency band broader than a telephone band into at least signals of a first frequency band and signals of a second frequency band, said second frequency band being lower on the frequency spectrum than the first frequency band.

3. The signal encoding method as claimed in claim 1, wherein the signals of the second frequency band are encoded in said step of encoding by a combination of a short-term predictive coding and an orthogonal transform coding.

4. The signal encoding method as claimed in claim 1, further comprising:

performing perceptually weighted quantization on a frequency axis on orthogonal transform coefficients obtained by said orthogonal transform step.

5. The signal encoding method as claimed in claim 1, wherein the signals of the first frequency band are processed with short-term predictive coding used in said step of performing a short-term prediction.

6. A signal encoding apparatus comprising:

band-splitting means for splitting an input signal into a plurality of frequency bands to provide a plurality of split frequency bands; and encoding means for encoding signals of each of said plurality of frequency bands in respective manners responsive to respective signal characteristics of each of the plurality of frequency bands and for multiplexing a first signal of one of the plurality of split frequency bands and a portion of a second signal of another of the plurality of split frequency bands that is not in common with said first signal;

wherein said encoding means includes:

means for finding short-term prediction residuals by a short-term prediction performed on a signal of a lowest one of said plurality of frequency bands;

means for finding long-term prediction residuals by performing a long-term prediction on the short-term prediction residuals; and orthogonal transform means for orthogonal-transforming the long-term prediction residuals, wherein said input signal is a broad-band input signal and said band-splitting means splits said broad-band input signal into at least a signal of a telephone frequency band and a signal in a frequency band higher on the frequency spectrum than said telephone frequency band.

7. A portable radio terminal apparatus including an antenna, the apparatus comprising:

first amplifier means for amplifying an input speech signal to provide a first amplified signal;

A/D conversion means for A/D converting the first amplified signal;

speech encoding means for encoding an output of said A/D conversion means to provide an encoded signal;

transmission path encoding means for channel-coding said encoded signal;

modulation means for modulating an output of said transmission path encoding means to provide a modulated signal;

D/A conversion means for D/A converting said modulated signal; and second amplifier means for amplifying a signal from said D/A conversion means to provide a second amplified signal and for supplying the second amplified signal to the antenna;

wherein said speech encoding means includes:

band-splitting means for splitting the output of said A/D conversion means into a plurality of frequency bands, wherein the plurality of frequency bands include a first frequency band and a second frequency band, said second frequency band being lower on the frequency spectrum than the first frequency band; and encoding means for encoding signals of each of said plurality of frequency bands in respective manners responsive to signal characteristics of said each of the plurality of frequency bands and for multiplexing a first signal of one of the plurality of frequency bands and a portion of a second signal of another of the plurality of frequency bands that is not in common with said first signal;

means for finding short-term prediction residuals by a short-term prediction performed on a signal of a lowest one of said plurality of frequency bands;

means for finding long-term prediction residuals by performing a long-term prediction on the short-term prediction residuals; and orthogonal transform means for orthogonal-transforming the long-term prediction residuals using a modified discrete cosine transform for the orthogonal transform with a predetermined transform length selected to be a power of 2.

8. A method for multiplexing an encoded signal comprising the steps of:

encoding an input signal with a first encoding employing a first bit rate for producing a first encoded signal;

encoding said input signal with a second encoding for producing a second encoded signal, said second encoded signal having a first portion in common with a portion of said first encoded signal and a second portion not in common with said first encoded signal, said second encoding employing a second bit rate different from said first bit rate; and multiplexing said first encoded signal and the second portion of said second encoded signal not in common with said first encoded signal;

wherein said step of encoding said input signal with a second encoding includes splitting the input signal into a first signal with a frequency band approximately equal to that of a telephone signal and a second signal with a frequency band higher on a frequency spectrum than said first signal and said common portion is the encoded signal derived from linear prediction parameters of the input signal.

9. The multiplexing method as claimed in claim 8, wherein said first portion is data obtained by a linear predictive analysis of said input signal followed by quantization of parameters representing linear prediction coefficients.

10. A portable radio terminal apparatus including an antenna, the apparatus comprising:

first amplifier means for amplifying an input speech signal to provide a first amplified signal;

A/D conversion means for A/D converting the amplified signal;

speech encoding means for encoding an output of said A/D conversion means to provide an encoded signal;

transmission path encoding means for channel-coding said encoded signal;

modulation means for modulating an output of said transmission path encoding means to provide a modulated signal;

D/A conversion means for D/A converting said modulated signal; and second amplifier means for amplifying a signal from said D/A conversion means to provide a second amplified signal and for supplying the second amplified signal to the antenna;

wherein said speech encoding means comprises:

means for multiplexing a first encoded signal obtained by a first encoding of the output of said A/D conversion means employing a first bit rate and a second encoded signal obtained by a second encoding of the output of said A/D conversion means, said second encoded signal having a first portion in common with a portion of said first encoded signal and a second portion not in common with said first encoded signal, said second encoding employing a second bit rate different from the first bit rate;

band-splitting means for splitting the output of said A/D conversion means into a plurality of frequency bands, wherein the plurality of frequency bands include a first frequency band and a second frequency band, said second frequency band being lower on the frequency spectrum than the first frequency band; and encoding means for encoding signals of each of said plurality of frequency bands in respective manners responsive to signal characteristics of said each of the plurality of frequency bands;

means for finding short-term prediction residuals by a short-term prediction performed on a signal of the second frequency band;

means for finding long-term prediction residuals by performing a long-term prediction on the short-term prediction residuals;

orthogonal transform means for orthogonal-transforming the long-term prediction residuals using a modified discrete cosine transform for the orthogonal transform with a predetermined transform length selected to be a power of 2; and means for multiplexing said first encoded signal and the second portion of the second encoded signal not in common with said first encoded signal.

* * * * *